US011338582B2

(12) United States Patent
Katayama et al.

(10) Patent No.: US 11,338,582 B2
(45) Date of Patent: May 24, 2022

(54) LIQUID DISCHARGE APPARATUS AND IMAGE RECORDING APPARATUS INCLUDING THE SAME

(71) Applicant: Brother Kogyo Kabushiki Kaisha, Nagoya (JP)

(72) Inventors: Hiroshi Katayama, Toyoake (JP); Shohei Koide, Nagoya (JP); Keita Hirai, Nagoya (JP); Keita Sugiura, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 57 days.

(21) Appl. No.: 16/816,938

(22) Filed: Mar. 12, 2020

(65) Prior Publication Data

US 2020/0307204 A1 Oct. 1, 2020

(30) Foreign Application Priority Data

Apr. 1, 2019 (JP) ..... JP2019-069788

(51) Int. Cl.
*B41J 2/14* (2006.01)

(52) U.S. Cl.
CPC ..... *B41J 2/14209* (2013.01); *B41J 2/14201* (2013.01); *B41J 2002/14225* (2013.01); *B41J 2002/14306* (2013.01); *B41J 2002/14419* (2013.01); *B41J 2002/14459* (2013.01); *B41J 2202/11* (2013.01); *B41J 2202/12* (2013.01)

(58) Field of Classification Search
CPC ..... B41J 2/14209; B41J 2/14201; B41J 2002/14225; B41J 2002/14306; B41J 2002/14419; B41J 2002/14459; B41J 2202/11; B41J 2202/12
See application file for complete search history.

(56) References Cited

U.S. PATENT DOCUMENTS

2010/0238238 A1* 9/2010 Yamamoto ..... B41J 2/18 347/85

FOREIGN PATENT DOCUMENTS

JP 2008-290292 A 12/2008

* cited by examiner

*Primary Examiner* — Geoffrey S Mruk
(74) *Attorney, Agent, or Firm* — Banner & Witcoff, Ltd.

(57) ABSTRACT

There is provided a liquid discharge apparatus configured to discharge a liquid, including a channel member for the liquid. The channel member is formed to include: individual channels; a first and second manifold channels; and a bypass channel. Each of the individual channels and the bypass channel are all connected to the first manifold channel on only one of an upper and lower sides of a central portion between upper and lower surfaces of the first manifold channel, and connected to the second manifold channel on only one of upper and lower sides of a central portion between upper and lower surfaces of the second manifold channel. A channel resistance of the bypass channel is smaller than that of the individual channels.

20 Claims, 19 Drawing Sheets

LIQUID DISCHARGE APPARATUS AND IMAGE RECORDING APPARATUS INCLUDING THE SAME

CROSS REFERENCE TO RELATED APPLICATION

The present application claims priority from Japanese Patent Application No. 2019-069788 filed on Apr. 1, 2019, the disclosure of which is incorporated herein by reference in its entirety.

BACKGROUND

The present disclosure relates to a liquid discharge apparatus and an image recording apparatus including the same.

An image recording apparatus is used, in which a liquid such as an ink or the like is discharged onto a medium such as recording paper or the like by the aid of a liquid discharge apparatus, and an image is recorded on the medium thereby. The liquid discharge apparatus is generally provided with pressure chambers which accommodate the liquid and nozzles which are connected in fluid communication with the pressure chambers. The liquid is discharged from the nozzle by raising the internal pressure of the pressure chamber by using an actuator or the like.

In relation to the liquid discharge apparatus and the image recording apparatus as described above, a problem is known such that the viscosity of the liquid is increased at the inside of the liquid discharge apparatus, and the deterioration in quality occurs in the recorded image. Japanese Patent Application Laid-open No. 2008-290292 discloses that this problem is dealt with by circulating the ink between the liquid discharge apparatus and an external tank.

SUMMARY

The contamination with bubbles in the liquid and the sedimentation of any component dispersed in the liquid (for example, the sedimentation of a pigment in the ink) are known in addition to the increase in viscosity of the liquid as the cause to deteriorate the quality of the image recorded by the liquid discharge apparatus and the image recording apparatus. Therefore, it is desirable for the liquid discharge apparatus to satisfactorily perform the discharge of bubbles mixed into the internal liquid and the prevention and the dissolution of the sedimentation of the component dispersed in the internal liquid.

An object of the present disclosure is to provide a liquid discharge apparatus and an image recording apparatus which make it possible to maintain an internal liquid in the liquid discharge apparatus to be in a satisfactory state suitable for the image formation by dealing with at least one of the contamination with bubbles in the liquid and the sedimentation of the component dispersed in the liquid.

According to a first aspect of the present disclosure, there is provided a liquid discharge apparatus configured to discharge a liquid, including a channel member for the liquid, wherein:

the channel member is formed to include:

a plurality of individual channels each of which has a nozzle configured to discharge the liquid;

a first manifold channel which extends in a first direction so as to be connected to each of the plurality of individual channels, and which is configured to allow the liquid to flow toward one end in the first direction of the first manifold channel so as to distribute the liquid to each of the plurality of individual channels;

a second manifold channel which extends in a second direction so as to be connected to each of the plurality of individual channels, and which is configured to allow the liquid to flow from each of the plurality of individual channels toward one end in the second direction of the second manifold channel; and a bypass channel which is connected to the first manifold channel and the second manifold channel, and which is configured to allow the liquid in the first manifold channel to flow to the second manifold channel;

each of the plurality of individual channels and the bypass channel are all connected to the first manifold channel on only one of an upper and lower sides of a central portion between upper and lower surfaces of the first manifold channel, and each of the plurality of individual channels and the bypass channel are all connected to the second manifold channel on only one of upper and lower sides of a central portion between upper and lower surfaces of the second manifold channel;

the bypass channel is connected to the first manifold channel on a side of the one end of the first manifold channel as compared with a connecting portion, among connecting portions between each of the plurality of individual channels and the first manifold channel, closest to the one end of the first manifold channel, and the bypass channel is connected to the second manifold channel on a side of an other end in the second direction of the second manifold channel as compared with a connecting portion, among connecting portions between each of the plurality of individual channels and the second manifold channel, closest to the other end of the second manifold channel, the other end of the second manifold channel being opposite to the one end of the second manifold channel; and a channel resistance of the bypass channel is smaller than a channel resistance of each of the plurality of individual channels.

According to a second aspect of the present disclosure, there is provided an image recording apparatus including:

the liquid discharge apparatus according to the first aspect;

a liquid supply channel configured to supply a liquid to the liquid discharge apparatus;

a liquid recovery channel configured to recover the liquid from the liquid discharge apparatus; and a pump configured to apply a pressure such that the liquid flows in an order of the liquid supply channel, the first manifold channel, the bypass channel, the second manifold channel, and the liquid recovery channel.

DESCRIPTION OF THE EMBODIMENTS

First Embodiment

An explanation will be made about an ink-jet head (liquid discharge apparatus) 110 of a first embodiment of the present disclosure and a printer (image recording apparatus) 1000 provided with the ink-jet head 110, while referring to a case in which an image is recorded on the sheet (recording paper) P by way of example.

<Printer 1000>

Figure 1:
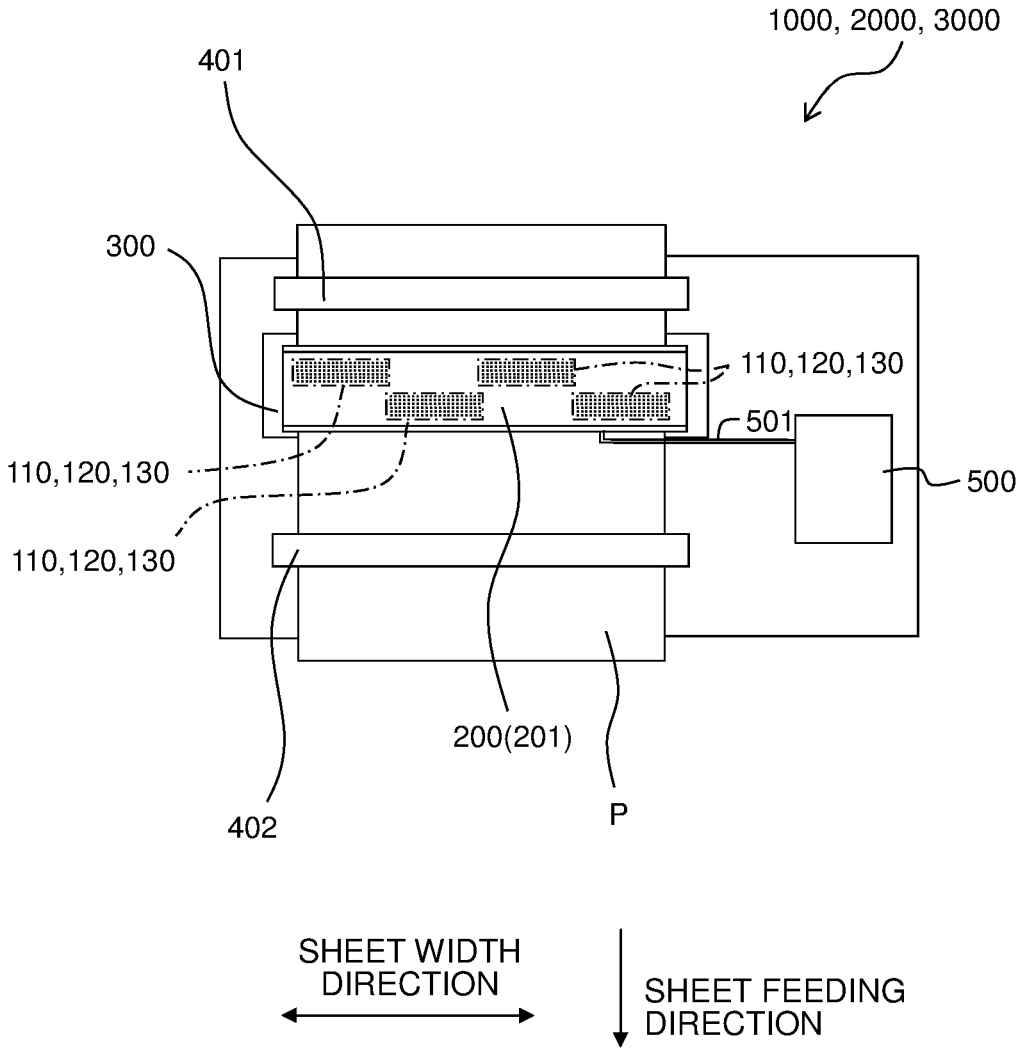
FIG. 1 depicts a schematic structure of a printer according to first, second, and third embodiments.

As depicted in FIG. 1, the printer 1000 of the first embodiment principally comprises a line head 200 which includes the four ink-jet heads 110, a platen 300 which is provided under the line head 200, a pair of conveyance rollers 401, 402 which are provided while interposing the platen 300, and an ink tank 500.

Figure 2:
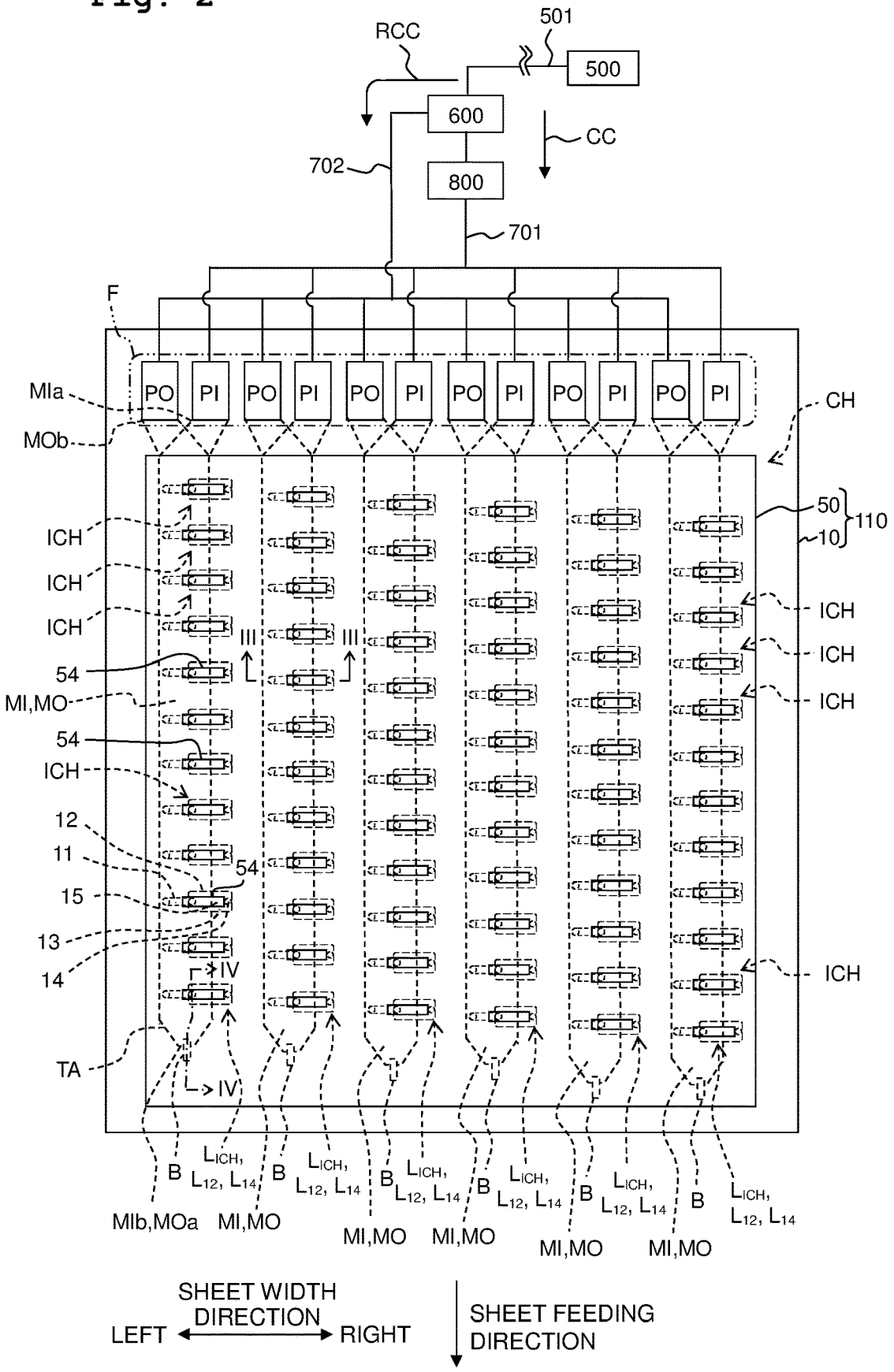
FIG. 2 is a schematic plan view depicting an ink-jet head of the first embodiment.

As depicted in FIG. 2, the printer 1000 further comprises a subtank 600 which accommodates the ink fed from the ink tank 500, an ink supply channel (liquid supply channel) 701 which feeds the ink contained in the subtank 600 to the ink-jet head 110, an ink recovery channel (liquid recovery channel) 702 which feeds the ink contained in the ink-jet head 110 to the subtank 600, and a pump 800 which is provided at an intermediate position of the ink supply channel 701. Note that FIGS. 1 and 2 are schematic views, and hence the shape of the ink-jet head 110 depicted in FIG. 1 as viewed in a plan view is not coincident with the shape of the ink-jet head 110 depicted in FIG. 2 as viewed in a plan view, but the ink-jet heads 110 depicted in FIGS. 1 and 2 are identical with each other.

In the following explanation, the direction in which the pair of conveyance rollers 401, 402 are aligned, i.e. the direction in which the sheet P is conveyed during the image formation is referred to as "sheet feeding direction" of the printer 1000 and the ink-jet head 110. As for the "sheet feeding direction", the upstream side in the direction in which the sheet P is conveyed is referred to as "sheet supply side", and the downstream side is referred to as "sheet discharge side". Further, the direction in the horizontal plane orthogonal to the sheet feeding direction, i.e., the direction in which the rotation axes of the conveyance rollers 401, 402 extend is referred to as "sheet width direction". The direction, which is orthogonal to the "sheet feeding direction" and the "sheet width direction", is referred to as "up-down direction (vertical direction)". In the explanation of the channels (flow passages) in this specification, the terms "upstream side" and "downstream side" mean the upstream side and the downstream side of the direction in which the liquid inside the channel flows.

The line head 200 is provided with a holding member (retaining member) 201 which has a longitudinal direction in the sheet width direction, which has a transverse direction in the sheet feeding direction, and which has a rectangular shape as viewed in a plan view, and the four ink-jet heads 110 which are held or retained by the holding member 201. The holding member 201 is supported by a support unit (not shown) at both ends in the longitudinal direction.

The four ink-jet heads 110 are installed in a zigzag form in the sheet width direction on the holding member 201. Each of the ink-jet heads 110 are retained by the holding member 201 with nozzles 14 being directed downwardly (as described later on).

The platen 300 is a plate-shaped member which supports the sheet P from the side (lower position) opposite to the ink-jet heads 110 when the ink is discharged from the ink-jet heads 110 to the sheet P. The width of the platen 300 in the sheet width direction is larger than the width of the largest sheet on which the image can be recorded by the printer 1000.

The pair of conveyance rollers 401, 402 are arranged while interposing the platen 300 in the sheet feeding direction. The pair of conveyance rollers 401, 402 feed the sheet P to the sheet discharge side in the sheet feeding direction in accordance with a predetermined mode when the image is formed on the sheet P by the ink-jet heads 110.

The ink tank 500 is an accommodating unit which accommodates the ink to be discharged by the ink-jet heads 110.

The subtank 600, the ink supply channel 701, the ink recovery channel 702, and the pump 800 are provided one by one with respect to each of the four ink-jet heads 110 on the holding member 201 of the line head 200.

The subtank 600 and the ink tank 500 are connected to one another by an ink channel member 501. Each of the ink supply channel 701 and the ink recovery channel 702 is connected to the subtank 600 at one end, and each of them is connected to the ink-jet heads 110 at the other end. The pump 800 circulates the ink along a circulating channel which is constructed by the ink supply channel 701, the ink-jet heads 110, the ink recovery channel 702, and the subtank 600. In FIG. 2, the pump 800 is provided at an intermediate position of the ink supply channel 701. However, there is no limitation thereto.

<Ink-jet head 110>

Next, the ink-jet head 110 will be explained.

Figure 3:
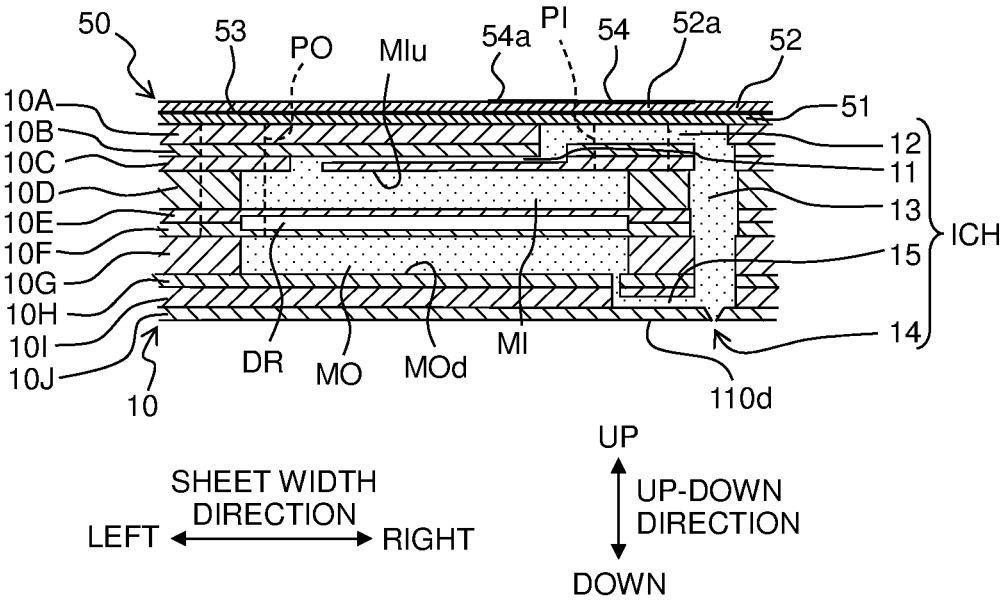
FIG. 3 is a sectional view taken along a line depicted in FIG. 2.

The ink-jet head 110 is constructed by a channel unit (channel member) 10 and a piezoelectric actuator 50 which is provided on the channel unit 10 (FIGS. 2 and 3).

<Channel unit 10>

The channel unit 10 is formed with channels CH in order that the ink supplied from the subtank 600 is distributed at appropriate positions to discharge the ink. The channel unit 10 has a stacked structure in which ten plates 10A to 10J are stacked in this order from the top. The channel CH is formed by removing parts of the respective plates 10A to 10J.

Figure 4:
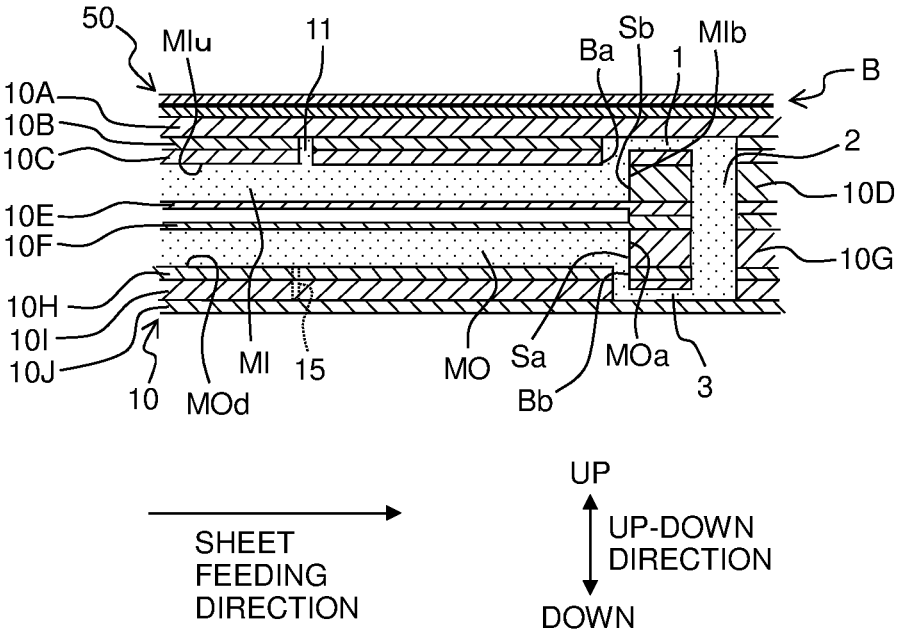
FIG. 4 is a sectional view taken along a line IV-IV depicted in FIG. 2.

As depicted in FIGS. 2 to 4, the channel CH includes a plurality of individual channels ICH which are arranged in the sheet feeding direction and the sheet width direction, supply manifold channels (first manifold channels) MI which distribute the ink supplied from the ink supply channel 701 to the plurality of individual channels ICH, and return manifold channels (second manifold channels) MO which merge the ink from the plurality of individual channels ICH to allow the ink to flow to the ink recovery channel 702. The channel CH further includes bypass channels B which allow the ink contained in the supply manifold channels MI to the return manifold channels MO while detouring the individual channels ICH, supply ports PI which connect the ink supply channel 701 and the supply manifold channels MI, and recovery ports PO which connect the ink recovery channel 702 and the return manifold channels MO.

The plurality of individual channels ICH, which are aligned in the sheet feeding direction, constitute individual channel arrays $L_{ICH}$. The supply manifold channel MI and the return manifold channel MO are provided one by one with respect to one individual channel array $L_{ICH}$. The return manifold channel MO is arranged under the supply manifold channel MI. In this embodiment, six arrays of the individual channel arrays $L_{ICH}$, each of which is constructed by the twelve individual channels $L_{ICH}$, are formed in the sheet width direction. The six supply ports PI, the six recovery ports PO, the six supply manifold channels MI, the six return manifold channels MO, and the six bypass channels B are also formed respectively.

As depicted in FIG. 3, each of the plurality of individual channels ICH includes a first throttle channel 11, a pressure chamber 12, a descender channel 13, a nozzle 14, and a second throttle channel 15 as referred to in this order from the upper side to the lower side along the flow of the ink.

The first throttle channel 11 is a channel for feeding the ink contained in the supply manifold channel MI to the pressure chamber 12. The first throttle channel 11 is formed by removing parts of the plates 10B, 10C. The upstream end of the first throttle channel 11 is connected to the supply manifold channel MI, and the downstream end of the first throttle channel 11 is connected to the pressure chamber 12.

The first throttle channel 11 is constructed to have a large channel resistance by decreasing the channel cross-sectional area and increasing the channel length. Accordingly, the counterflow of the ink, which is directed from the pressure chamber 12 to the supply manifold channel MI, is suppressed when the pressure is applied to the pressure chamber 12 (as described later on).

The pressure chamber 12 is a space for applying the pressure brought about by the piezoelectric actuator 50 to the ink. The pressure chamber 12 is formed by removing a part of the plate 10A positioned at the uppermost portion of the channel unit 10. The upper surface of the pressure chamber 12 is formed by a first piezoelectric layer 51 of the piezoelectric actuator 50 (as described later on).

The shape of the pressure chamber 12, which is viewed in a plan view, is a substantially rectangular shape which is long in the sheet width direction (FIG. 2). The first throttle channel 11 is connected to a portion disposed in the vicinity of one short side, and the descender channel 13 is connected to a portion disposed in the vicinity of the other short side. The twelve pressure chambers 12, which are aligned in the sheet feeding direction, constitute the pressure chamber array $L_{12}$.

The descender channel 13 is a channel for allowing the ink contained in the pressure chamber 12 to flow to the nozzle 14. The descender channel 13 is formed by coaxially providing circular through-holes through the plates 10B to 10I respectively. The descender channel 13 extends in the up-down direction from the pressure chamber 12 toward the nozzle 14.

The nozzle 14 is a minute opening for discharging the ink toward the sheet P. The nozzle 14 is formed through the plate 10J positioned at the lowermost portion of the channel unit 10. The twelve nozzles 14, which are aligned in the sheet feeding direction, constitute the nozzle array $L_{14}$. The lower surface of the plate 10J, on which the nozzles 14 and the nozzle array $L_{14}$ are formed, is the lower surface 110*d* of the ink-jet head 100. The adjoining individual channel arrays $L_{ICH}$ are arranged while being slightly deviated from each other in the sheet feeding direction, and the adjoining nozzle arrays $L_{14}$ are arranged in the same manner as described above. Therefore, the nozzles 14 are arranged on the lower surface 110*d* while providing substantially no gap in the sheet feeding direction.

The second throttle channel 15 is a channel for allowing a part of the ink contained in the nozzle 14 to flow toward the return manifold channel MO. The second throttle channel 15 is formed by removing parts of the plates 10H, 10I. The second throttle channel 15 is connected to the circumferential surface of the descender channel 13 at the upstream end, and the second throttle channel 15 is connected to the lower surface MOd of the return manifold channel MO at the downstream end.

The second throttle channel 15 is constructed to have a large channel resistance by decreasing the channel cross-sectional area. Accordingly, the flow of the ink from the descender channel 13 to the return manifold channel MO is suppressed when the pressure is applied to the pressure chamber 12 (as described later on).

The six supply ports PI and the six recovery ports PO are arranged alternately in the sheet width direction in the vicinity of the end portion of the channel unit 10 on the sheet supply side in the sheet feeding direction. As depicted in FIG. 3, each of the six supply ports PI is formed by coaxially providing through-holes through the plates 10A to 10C respectively. Each of the six supply ports PI is connected to the ink supply channel 701 on the upper side and connected to the supply manifold channel MI on the lower side. Each of the six recovery ports PO is formed by coaxially providing through-holes through the plates 10A to 10F respectively. Each of the six recovery ports PO is connected to the ink recovery channel 702 on the upper side and connected to the return manifold channel MO on the lower side.

A filter F, which avoids any passage of any foreign matter or the like contained in the ink, is provided at the connecting portion between each of the supply ports PI and the ink supply channel 701 and at the connecting portion between each of the recovery ports PO and the ink recovery channel 702.

Each of the six supply manifold channels MI is formed by removing a part of the plate 10D. Each of the supply manifold channels MI extends to the sheet discharge side in the sheet feeding direction while being inclined with respect to the sheet feeding direction from the upstream end MIa connected to the supply port PI, and then each of the supply manifold channels MI is bent to extend to the sheet discharge side linearly in the sheet feeding direction. The downstream end MIb of each of the supply manifold channels MI is positioned on the downstream side as compared with the individual channel ICH which is disposed on the most downstream side and which is included in the plurality of individual channels ICH for constructing the corresponding individual channel array $L_{ICH}$.

The upper surface MIu of each of the supply manifold channels MI is formed by the lower surface of the plate 10C. The first throttle channels 11 of the plurality of individual channels ICH of the corresponding individual channel array $L_{ICH}$ are connected to the upper surface MIu at equal intervals while being aligned in the extending direction of the supply manifold channels MI.

A tapered area TA, in which the width of the channel is gradually narrowed at positions disposed on the more downstream side, is provided in the area disposed in the vicinity of the downstream end MIb, i.e., in the area disposed on the downstream side as compared with the individual channel ICH which is positioned on the most downstream side and which is included in the plurality of individual channels ICH connected to the supply manifold channel MI. The upstream end Ba of the bypass channel B is connected to the upper surface MIu (as described later on) on the most downstream side of the tapered area TA, i.e., at the position at which the width of the channel is narrowest.

Each of the six return manifold channels MO is formed by removing a part of the plate 10G. Each of the return manifold channels MO extends to the sheet discharge side in the sheet feeding direction while being inclined with respect to the sheet feeding direction from the downstream end MOb connected to the recovery port PO, and then each of the return manifold channels MO is bent to extend to the sheet discharge side linearly in the sheet feeding direction. The upstream end MOa of each of the return manifold channels MO is positioned on the upstream side as compared with the individual channel ICH which is disposed on the most upstream side and which is included in the plurality of individual channels ICH for constructing the corresponding individual channel array $L_{ICH}$.

The portion of each of the return manifold channels MO, which extends linearly in the sheet feeding direction, is formed just under the linear portion of each of the supply manifold channels MI so that the portion of each of the return manifold channels MO is overlapped with the linear portion of each of the supply manifold channels MI as viewed in a plan view. Accordingly, the channels are efficiently arranged, and the channel unit 10 is small-sized.

The lower surface MOd of each of the return manifold channels MO is formed by the upper surface of the plate 10H. The second throttle channels 15 of the plurality of individual channels ICH of the corresponding individual channel array $L_{ICH}$ are connected at equal intervals to the lower surface MOd while being aligned in the extending direction of the return manifold channel MO.

A tapered area TA, in which the width of the channel is gradually narrowed at positions disposed on the more upstream side, is provided in the area disposed in the vicinity of the upstream end MOa, i.e., in the area disposed on the upstream side as compared with the individual channel ICH which is positioned on the most upstream side and which is included in the plurality of individual channels ICH connected to the return manifold channel MO. The downstream end Bb of the bypass channel B is connected to the lower surface MOd (as described later on) on the most upstream side of the tapered area TA, i.e., at the position at which the width of the channel is narrowest.

Recesses are formed on the lower surface of the plate 10E and the upper surface of the plate 10F respectively, and the plates 10E, 10F are thinned in the area in which the supply manifold channel MI and the return manifold channel MO are overlapped with each other in the up-down direction. Accordingly, a damper chamber DR is defined between the plate 10E and the plate 10F, in other words, between the supply manifold channel MI and the return manifold channel MO.

When the damper chamber DR is provided, the plate 10E for constructing the lower surface of the supply manifold channel MI and the plate 10F for constructing the upper surface of the return manifold channel MO can be thereby deformed respectively. Owing to the deformation, the pressure fluctuation of the ink is suppressed in the supply manifold channel MI and in the return manifold channel MO.

As depicted in FIG. 4, each of the six bypass channels B includes an inflow channel 1, a connecting channel 2, and an outflow channel 3 along with the flow of the ink from the upstream side to the downstream side.

The inflow channel 1 extends upwardly from the downstream end MIb of the supply manifold channel MI, and then the inflow channel 1 is bent to extend in the direction to make separation from the supply manifold channel MI along with the sheet feeding direction. The inflow channel 1 is formed by removing parts of the plates 10B, 10C. The upstream end of the inflow channel 1 is the upstream end Ba of the bypass channel B.

The connecting channel 2 is a channel which connects the inflow channel 1 and the outflow channel 3. The connecting channel 2 is formed by coaxially providing through-holes through the plates 10C to 10I respectively. The connecting channel 2 extends in the up-down direction. The connecting channel 2 is connected to the downstream end of the inflow channel 1 at the upper end, and the connecting channel 2 is connected to the upstream end of the outflow channel 3 at the lower end.

The outflow channel 3 is a channel which extends in the direction to make approach to the return manifold channel MO along with the sheet feeding direction from the lower end of the connecting channel 2, which is thereafter bent to extend upwardly, and which is connected to the return manifold channel MO. The outflow channel 3 is formed by removing parts of the plates 10H, 10I. The downstream end of the outflow channel 3 is the downstream end Bb of the bypass channel B.

The cross-sectional shape of the bypass channel B, which is taken along the plane that is orthogonal to the extending direction, is, for example, circular at the portion where the bypass channel B extends in the up-down direction, and the cross-sectional shape is rectangular or square at the portion where the bypass channel B extends in the sheet feeding direction. Further, as for the dimension of the cross-sectional shape, for example, the diameter is about 50 μm to 200 μm at the portion at which the cross-sectional shape is circular, and one side is about 50 μm to 200 μm at the portion at which the cross-sectional shape is rectangular or square. Note that in FIG. 4, the diameter of the cross-sectional shape of the connecting channel 2 is larger than the heights of the cross-sectional shapes of the inflow channel 1 and the outflow channel 3. However, there is no limitation thereto. For example, the diameter of the cross-sectional shape of the connecting channel 2 may be smaller than the height of the cross-sectional shape of the inflow channel 1 and/or the outflow channel 3. Alternatively, the diameters (heights) of the cross-sectional shapes of the inflow channel 1, the connecting channel 2, and the outflow channel 3 may be identical with each other.

The channel length between the upstream end Ba and the downstream end Bb of the bypass channel B is, for example, about 1000 μm to 2000 μm.

Figure 5B:
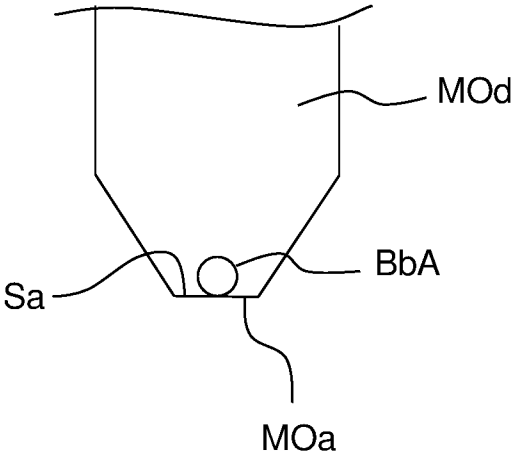
FIG. 5B is a plan view depicting a connecting portion of the bypass channel with respect to a return manifold channel of the first embodiment.
Figure 5A:
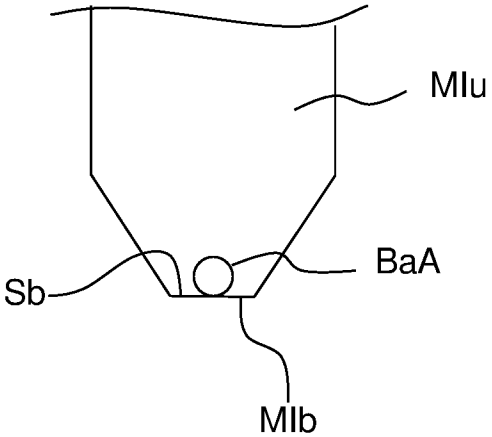
FIG. 5A is a plan view depicting a connecting portion of a bypass channel with respect to a supply manifold channel of the first embodiment.

The upstream end Ba of the bypass channel B is connected to the upper surface MIu of the supply manifold channel MI at the downstream end MIb of the supply manifold channel MI to define a circular opening BaA (FIG. 5A). The opening BaA makes contact with the end surface Sb positioned at the downstream end MIb of the supply manifold channel MI. That is, the portion of the circumferential surface of the inflow channel 1, which is positioned on the most downstream side of the supply manifold channel MI, is flush with the end surface Sb disposed on the downstream side of the supply manifold channel MI.

The downstream end Bb of the bypass channel B is connected to the lower surface MOd of the return manifold channel MO at the upstream end MOa of the return manifold channel MO to define a circular opening BbA (FIG. 5B). The opening BbA makes contact with the end surface Sa positioned at the upstream end MOa of the return manifold channel MO. That is, the portion of the circumferential surface of the outflow channel 3, which is positioned on the most upstream side of the return manifold channel MO, is flush with the end surface Sa disposed on the upstream side of the return manifold channel MO.

The channel resistance of the bypass channel B constructed as described above is smaller than about 12 kpa·s/cc assuming that the viscosity of the liquid flowing inside the channel is 1 cps. Note that the channel resistance of the individual channel ICH is about $11\times10^3$ to $13\times10^3$ kpa·s/cc, which is about 1000 times the channel resistance of the bypass channel B, assuming that the viscosity of the liquid flowing inside the channel is 1 cps. The channel resistance of the bypass channel B may be not more than 1/500 of the channel resistance of the individual channel ICH, and the channel resistance of the bypass channel B may be not more than 1/1000 of the channel resistance of the individual channel ICH. Note that the channel resistance has a value which is calculated on the basis of, for example, the length and the cross-sectional area of the channel. In general, if the cross-sectional areas of the channels are identical, then the channel resistance is larger when the length of the channel is longer. If the lengths of the channels are identical, then the channel resistance is larger when the cross-sectional area of the channel is small.

Further, the channel resistances of the supply manifold channel MI and the return manifold channel MO are about 2 to 4 kpa·s/cc assuming that the viscosity of the liquid flowing inside the channel is 1 cps. The channel resistance of the bypass channel B is about three times to six times the channel resistances of the supply manifold channel MI and the return manifold channel MO.

<Piezoelectric Actuator 50>

The piezoelectric actuator 50 is constructed by a first piezoelectric layer 51 which is provided on the upper surface of the channel unit 10, a second piezoelectric layer 52 which is disposed over or above the first piezoelectric layer 51, a common electrode 53 which is interposed by the first piezoelectric layer 51 and the second piezoelectric layer 52, and a plurality of individual electrodes 54 which are provided on the upper surface of the second piezoelectric layer 52.

The first piezoelectric layer 51 is provided on the upper surface of the plate 10A so that the first piezoelectric layer 51 covers all of the plurality of individual channels ICH formed for the channel unit 10. The common electrode 53 is provided on the upper surface of the first piezoelectric layer 51 while covering the substantially entire region of the upper surface of the first piezoelectric layer 51. The second piezoelectric layer 52 is provided on the upper surface of the common electrode 53 while covering the entire regions of the first piezoelectric layer 51 and the common electrode 53.

The first piezoelectric layer 51 and the second piezoelectric layer 52 are formed of a piezoelectric material containing a main component of, for example, lead zirconate titanate (PZT) which is mixed crystal of lead titanate and lead zirconate. Note that the first piezoelectric layer 51 may be formed of an insulating material other than the piezoelectric material, for example, a synthetic resin material or the like.

The common electrode 53 is grounded via a trace (not depicted). The common electrode 53 is always retained at the ground electric potential.

Each of the plurality of individual electrodes 54 has a substantially rectangular planar shape in which the sheet width direction is the longitudinal direction (FIG. 2). The plurality of individual electrodes 54 are provided on the upper surface of the second piezoelectric layer 52 so that the plurality of individual electrodes 54 are positioned respectively over or above the pressure chambers 12 of the plurality of individual channels ICH (FIG. 2). Each of the plurality of individual electrodes 54 is positioned so that each of the plurality of individual electrodes 54 is positioned over or above the central portion of the corresponding pressure chamber 12.

Portions of the second piezoelectric layer 52, which are interposed by the common electrode 53 and the plurality of respective individual electrodes 54, serve as active portions 52*a* which are polarized in the thickness direction in the structure in which the first piezoelectric layer 51, the second piezoelectric layer 52, the common electrode 53, and the plurality of individual electrodes 54 are arranged as described above.

A connecting terminal 54*a* is defined at the end portion of each of the plurality of individual electrodes 54 disposed on one side in the sheet width direction (end portion positioned on the side opposite to the descender channel 13 of the pressure chamber 12 as viewed in a plan view). Each of the individual electrodes 54 is connected to driver IC (not depicted) via the connecting terminal 54*a* and a trace (not depicted). The driver IC individually applies any one of the ground electric potential and the predetermined driving electric potential (for example, about 20 V) to the plurality of individual electrodes 54 respectively.

For applying the pressure to the ink contained in a predetermined pressure chamber 12 (referred to as "target pressure chamber") by using the piezoelectric actuator 50, the driver IC applies the driving electric potential to the individual electrode 54 corresponding to the target pressure chamber. As a result, the electric field, which is parallel to the polarization direction, is generated in the active portion 52*a* which is interposed by the common electrode 53 and the individual electrode 54 applied with the driving electric potential. The active portion 52*a* is shrunk in the horizontal direction orthogonal to the polarization direction.

In accordance with the shrinkage, the stack of the first piezoelectric layer 51, the common electrode 53, the second piezoelectric layer 52, and the individual electrode 54, which is positioned over or above the target pressure chamber, is deformed (warped or flexibly bent) so that the stack protrudes toward the target pressure chamber. The volume of the target pressure chamber is decreased, and the pressure of the ink contained therein is raised. As a result, liquid droplets of the ink are discharged from the nozzle 14 which is communicated with the pressure chamber 12 via the descender channel 13.

<Image Forming Method>

An image is formed on the sheet P as described below by using the printer 1000 and the ink-jet head 110.

At first, the sheet P accommodated in the sheet supply tray (not depicted) is fed to the sheet supply side of the conveyance roller 401, and the sheet P is fed onto the platen 300 by means of the conveyance roller 401. The plurality of respective ink-jet heads 110 discharge the liquid droplets of the ink onto the sheet P to progressively form the image on the sheet P during the period in which the sheet P is fed by the conveyance rollers 401, 402. The sheet P, on which the image has been formed, is fed to the sheet discharge side of the conveyance roller 402, and the sheet P is discharged to the discharge tray (not depicted).

The liquid droplets of the ink are discharged from the ink-jet head 110 by applying the pressure by means of the piezoelectric actuator 50 to the ink contained in the pressure chamber 12 of the desired individual channel ICH included in the plurality of individual channels ICH. Accordingly, the liquid droplets of the ink are discharged from the nozzle 14 of the individual channel ICH toward the sheet P. Further, simultaneously with the discharge, the flow of the ink is generated from the subtank 600 via the ink supply channel 701, the inflow port PI, and the supply manifold channel MI to arrive at the individual channel ICH. The ink is supplied to the pressure chamber 12 and the descender channel 13.

Further, the printer 1000 maintains the circulation of the ink (hereinafter simply referred to as "ink circulation") along the circulating channel CC from the subtank 600 via the ink supply channel 701, the supply manifold channel MI, the bypass channel B or the individual channel ICH, the return manifold channel MO, and the ink recovery channel 702 to return to the subtank 600 by means of the pump 800 even in the period in which the ink is not discharged by the ink-jet head 110. Accordingly, the ink, which would otherwise stay in the individual channel ICH for a long term, is prevented from the occurrence of any change in characteristic (for example, the increase in concentration due to any drying).

<Discharge of Bubbles by Bypass Channel>

Next, an explanation will be made about the discharge of bubbles by using the bypass channel B of this embodiment.

In general, the ink contained in the ink-jet head is contaminated with bubbles in some cases. The bubbles do not affect the image formation directly as long as the bubbles exist in the manifold channel. However, if the pressure is applied to the ink contained in the pressure chamber in a state in which the pressure chamber and/or the descender channel is/are contaminated with the bubbles, it is feared that the applied pressure may be used to compress the bubbles, and the ink is not discharged normally.

In this respect, in the case of the ink-jet head 110 of this embodiment, the bypass channel B, which has the channel resistance smaller than that of the individual channel ICH (about 1/1000), is connected to the downstream end of the supply manifold channel MI. Therefore, most of the ink flowing through the supply manifold channel MI in accordance with the ink circulation flows into the bypass channel B, and the ink flows to the return manifold channel MO while detouring the individual channel ICH. Owing to this flow, the bubbles are discharged from the supply manifold channel MI.

In particular, in the case of the ink-jet head 110 of this embodiment, the upstream end Ba of the bypass channel B is also connected to the upper surface MIu of the supply manifold channel MI to which the individual channels ICH are connected. The ink, which flows through the supply manifold channel MI in accordance with the ink circulation, has the flow rate which is especially increased in the vicinity of the upper surface MIu to which the upstream end Ba of the bypass channel B is connected. Therefore, the bubbles, which exist in the vicinity of the upper surface MIu of the supply manifold channel MI, are discharged especially quickly. The individual channel ICH, which is connected to the upper surface MIu, is reliably suppressed from the contamination with the bubbles. Note that the bubbles gather at upper portions on account of the buoyancy. Therefore, the successful quick discharge of the bubbles existing in the vicinity of the upper surface MIu of the supply manifold channel MI means the successful quick discharge of the greater part of the bubbles existing in the supply manifold channel MI.

Further, in the case of the ink-jet head 110 of this embodiment, the tapered portion TA is provided in the vicinity of the downstream end MIb of the supply manifold channel MI. Therefore, the ink, which flows through the supply manifold channel MI, has the flow rate which is further increased at positions nearer to the downstream end MIb. Further, the channel resistance of the bypass channel B is larger than the channel resistance of the supply manifold channel MI (about three to six times). Therefore, the flow rate of the ink is also further increased when the ink flows into the bypass channel B. On account of the further acceleration of the ink, the bubbles G, with which the ink is contaminated, are fed into the bypass channel B more reliably. Further, the portion of the circumferential surface of the inflow channel 1 of the bypass channel B, which is positioned on the most downstream side of the supply manifold channel MI, is flush with the end surface Sb disposed on the downstream side of the supply manifold channel MI. Therefore, the bubbles are also suppressed from staying at the step portion.

<Prevention and Dissolution of Sedimentation by Means of Bypass Channel>

Next, an explanation will be made about the prevention and the dissolution of the sedimentation by using the bypass channel B of this embodiment.

In general, when the image is formed by using the ink-jet head, the sedimentation sometimes occurs in the ink at the inside of the ink-jet head (i.e., such a phenomenon occurs that the pigment, which is dispersed in the liquid in the ink, gathers on the lower side on account of the gravity). If the pigment, which is accumulated on the lower surface of the channel on account of the sedimentation, closes or clogs the connecting portion with respect to the individual channel, then the flow of the ink passing through the individual channel is inhibited, and it is feared that any influence may be exerted on the discharge of the ink.

In this respect, in the case of the ink-jet head 110 of this embodiment, the bypass channel B is connected to the upstream end of the return manifold channel MO. The ink is fed from the supply manifold channel MI via the bypass channel B. Therefore, the ink, which is contained in the return manifold channel MO, is agitated by the ink which outflows from the bypass channel B. The occurrence of the sedimentation is suppressed.

In particular, in the case of the ink-jet head 110 of this embodiment, the downstream end Bb of the bypass channel B is also connected to the lower surface MOd of the return manifold channel MO to which the individual channel ICH is connected. The ink, which flows through the return manifold channel MO in accordance with the ink circulation, has the flow rate which is especially increased in the vicinity of the lower surface MOd to which the downstream end Bb of the bypass channel B is connected, on account of the flow of the ink that outflows from the downstream end Bb of the bypass channel B. Therefore, the ink is agitated especially greatly in the vicinity of the lower surface MOd of the return manifold channel MO. The accumulation of the pigment is suppressed more reliably at the connecting portion of the individual channel ICH connected to the lower surface MOd. Further, even if the accumulation of the pigment exists on the lower surface MOd, then the accumulated pigment is agitated by the ink outflowing from the bypass channel B, and the accumulation is dissolved.

Main effects of the ink-jet head 110 and the image recording apparatus 1000 of this embodiment are summarized below.

The ink-jet head 110 of this embodiment is provided with the bypass channel B which connects the supply manifold channel MI and the return manifold channel MO while detouring the individual channel ICH and which has the channel resistance smaller than that of the individual channel. On this account, most of the bubbles, with which the ink contained in the supply manifold channel MI is contaminated, can be quickly discharged via the bypass channel B. In particular, the connecting portion of the bypass channel B with respect to the supply manifold channel MI is the upper surface MIu of the supply manifold channel MI. Therefore, the flow rate of the ink in the supply manifold channel MI is especially increased in the vicinity of the upper surface MIu. The individual channel ICH, which is connected to the upper surface MIu as well, can be more reliably suppressed from the contamination with the bubbles.

The ink-jet head 110 of this embodiment is provided with the bypass channel B which connects the supply manifold channel MI and the return manifold channel MO. Therefore, the ink contained in the return manifold channel MO can be agitated by the ink outflowing from the bypass channel B. In particular, the connecting portion of the bypass channel B with respect to the return manifold channel MO is the lower surface MOd of the return manifold channel MO. Therefore, the flow rate of the ink in the return manifold channel MO is especially increased in the vicinity of the lower surface MOd. The connecting portion of the individual channel ICH connected to the lower surface MOd as well can be more reliably suppressed from the sedimentation of the pigment.

The image recording apparatus 1000 of this embodiment can satisfactorily form the image by using the ink which is maintained in the satisfactory state by the ink-jet head 110 of this embodiment.

Modified Embodiment

The following modification mode can be also adopted in the embodiment described above.

In the ink-jet head 110 of the embodiment described above, the pump 800 circulates the ink along the circulating channel CC as starting from the subtank 600 to return to the subtank 600 via the ink supply channel 701, the supply manifold channel MI, the bypass channel B or the individual channel ICH, the return manifold channel MO, and the ink recovery channel 702. However, there is no limitation thereto. The pump 800 may circulate the ink along the circulating channel RCC in which the direction of the flow of the ink is opposite from that of the circulating channel CC.

In the circulating channel RCC, the ink contained in the subtank 600 flows into the return manifold channel MO via the ink recovery channel 702 and the recovery port PO, and the ink is distributed to the respective individual channels ICH. In another situation, the ink flows to the supply manifold channel MI via the bypass channel B. The ink allowed to flow from each of the individual channels ICH to the supply manifold channel MI and the ink allowed to flow from the bypass channel B to the supply manifold channel MI are returned to the subtank 600 via the supply port PI and the ink supply channel 701.

This modification mode is also operated in the same manner as the embodiment described above. That is, the flow rate of the ink is increased in the vicinity of the lower surface MOd of the return manifold channel MO to effect the prevention and the dissolution of the sedimentation. The flow rate of the ink is increased in the vicinity of the upper surface MIu of the supply manifold channel MI to discharge the bubbles. Therefore, the ink contained in the return manifold channel MO and the ink contained in the supply manifold channel MI can be retained in the satisfactory state suitable for the image formation.

In this modification mode, the return manifold channel MO is an example of the "first manifold channel" of the present invention, and the supply manifold channel MI is an example of the "second manifold channel" of the present invention. In this modification mode, the individual channel ICH and the bypass channel B are connected to the lower surface of the return manifold channel MO which is an example of the "first manifold channel" of the present invention and the upper surface of the supply manifold channel MI which is an example of the "second manifold channel" of the present invention.

Second Embodiment

An explanation will be made about an ink-jet head (liquid discharge apparatus) 120 of a second embodiment of the present disclosure and a printer (image recording apparatus) 2000 provided with the same.

The printer 2000 (FIG. 1) is the same as the printer 1000 of the first embodiment except that the printer 2000 is provided with the ink-jet head 120 in place of the ink-jet head 110. In the following description, only the ink-jet head 120 will be explained.

<Ink-Jet Head 120>

Next, the ink-jet head 120 will be explained.

Figure 6:
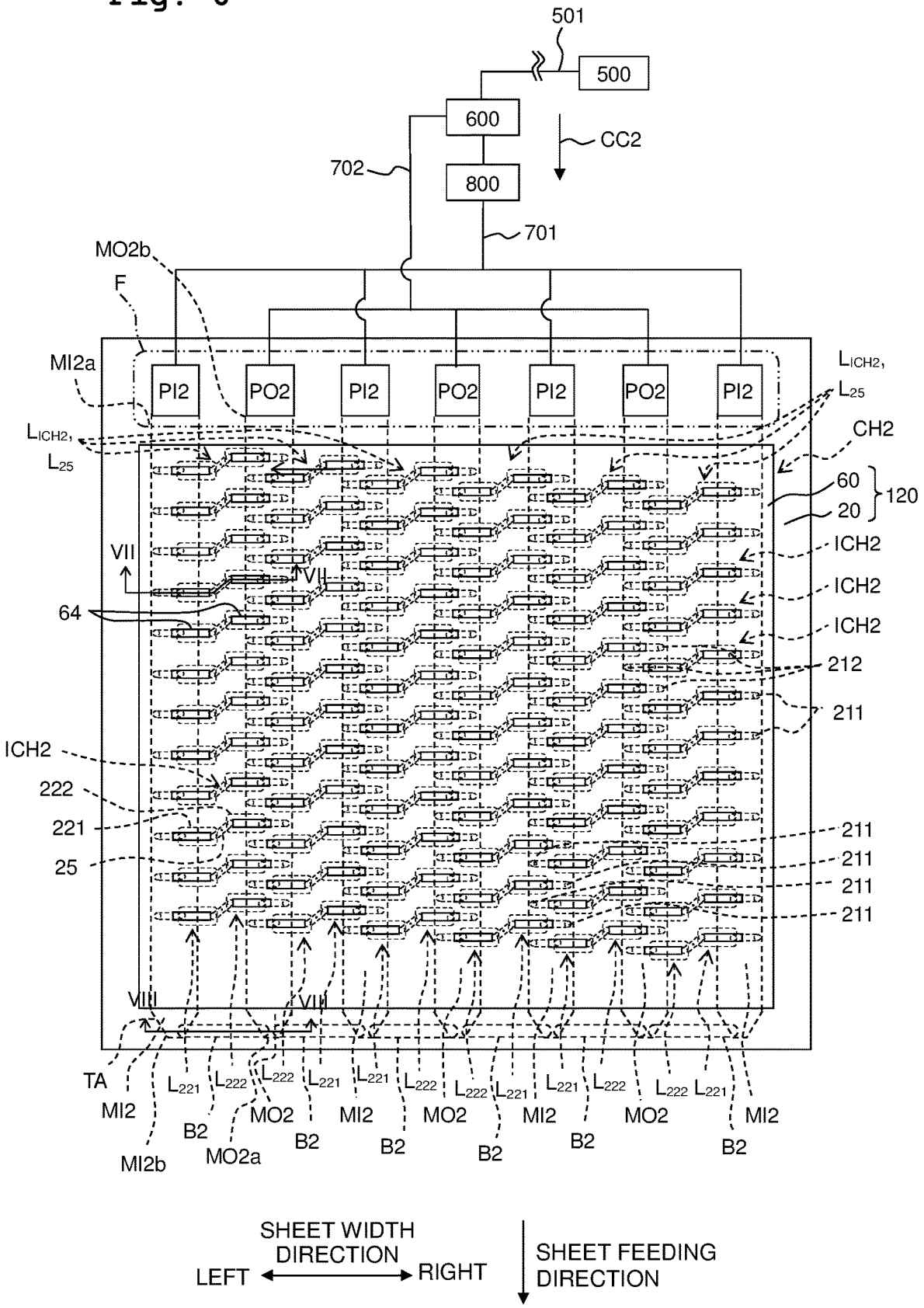
FIG. 6 is a schematic plan view depicting an ink-jet head of a second embodiment.
Figure 7:
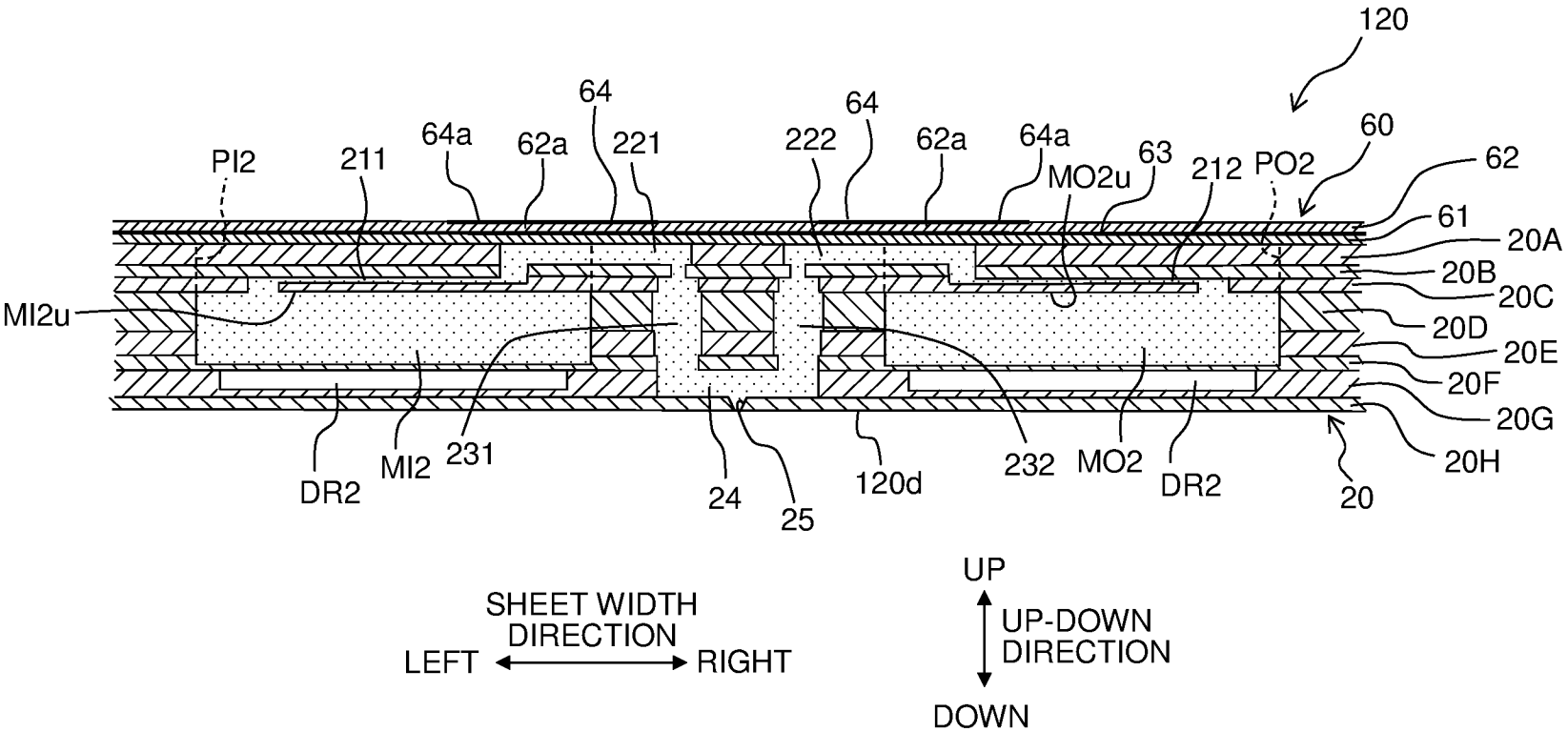
FIG. 7 is a sectional view taken along a line VII-VII depicted in FIG. 6.

As depicted in FIGS. 6 and 7, the ink-jet head 120 is constructed by a channel unit (channel member) 20 and a piezoelectric actuator 60 which is provided on the channel unit 20.

<Channel Unit 20>

The channel unit 20 is formed with channel CH2 in order that the ink supplied from the subtank 600 is distributed at appropriate positions to discharge the ink. The channel unit 20 has a stacked structure in which eight plates 20A to 20H are stacked in this order from the top. The channel CH2 is formed by removing parts of the respective plates 20A to 20H.

As depicted in FIGS. 6 and 7, the channel CH2 includes a plurality of individual channels ICH2 which are arranged in the sheet feeding direction and the sheet width direction, supply manifold channels (first manifold channels) MI2 which distribute the ink supplied from the ink supply channel 701 to the plurality of individual channels ICH2, and return manifold channels (second manifold channels) MO2 which merge the ink from the plurality of individual channels ICH2 to allow the ink to flow to the ink recovery channel 702. The channel CH2 further includes bypass channels B2 which connect the supply manifold channels MI2 and the return manifold channels MO2 while detouring the individual channels ICH2, supply ports PI2 which connect the ink supply channels 701 and the supply manifold channels MI2, and recovery ports PO2 which connect the ink recovery channels 702 and the return manifold channels MO2.

The twelve individual channels ICH2, which are aligned in the sheet feeding direction, constitute individual channel arrays $L_{ICH2}$. The supply manifold channel MI2 and the return manifold channel MO2 are arranged in parallel to each of the individual channel arrays $L_{ICH2}$ on the both sides in the sheet width direction of each of the individual channel arrays $L_{ICH2}$.

With respect to each of the supply manifold channels MI2, the respective individual channels ICH2 of the individual channel arrays $L_{ICH2}$ positioned on the both sides of the each of the supply manifold channels MI2 in the sheet width direction are connected thereto except for the supply manifold channels MI2 positioned at the both end portions in the sheet width direction. With respect to each of the return manifold channels MO2, the respective individual channels ICH2 of the individual channel arrays $L_{ICH2}$ positioned on the both sides of each of the return manifold channels MO2 in the sheet width direction are connected thereto.

In this embodiment, the six arrays of the individual channel arrays $L_{ICH2}$, the four supply manifold channels MI2, and the three return manifold channels MO2 are aligned from one end side to the other end side in the sheet width direction in an order of the supply manifold channel MI2, the individual channel array $L_{ICH2}$, the return manifold channel MO2, and the individual channel array $L_{ICH2}$.

Four supply ports PI2 in total are provided such that the supply port PI2 is provided one by one with respect to each of the supply manifold channels MI2. Three recovery ports PO2 in total are provided such that the recovery port PO2 is provided one by one with respect to each of the return manifold channels MO2.

Six bypass channels B2 are provided to connect the supply manifold channels MI2 and the return manifold channels MO2 which are disposed adjacently in the sheet width direction.

Each of the individual channels ICH2 includes a first throttle channel 211, a first pressure chamber 221, a first descender channel 231, a connecting channel 24, a nozzle 25, a second descender channel 232, a second pressure chamber 222, and a second throttle channel 212 as referred to in this order from the upstream side to the downstream side of the flow of the ink.

The first throttle channel 211 and the second throttle channel 212 are formed by removing parts of the plates 20B, 20C. The first throttle channel 211 is connected to the supply manifold channel MI2 at the upstream end, and the first throttle channel 211 is connected to the first pressure chamber 221 at the downstream end. The second throttle channel 212 is connected to the second pressure chamber 222 at the upstream end, and the second throttle channel 212 is connected to the return manifold channel MO2 at the downstream end.

The first pressure chamber 221 and the second pressure chamber 222 are formed by removing parts of the plate 20A positioned at the uppermost portion of the channel unit 20. The shapes of the first pressure chamber 221 and the second pressure chamber 222 as viewed in a plan view are substantially rectangular shapes which are long in the sheet width direction respectively (FIG. 6). The first throttle channel 211 and the second throttle channel 212 are connected to portions disposed in the vicinity of one short side, and the first descender channel 231 and the second descender channel 232 are connected to portions disposed in the vicinity of the other short side. As depicted in FIG. 6, the first pressure chamber 221 and the second pressure chamber 222 are formed while being deviated in the sheet feeding direction.

The twelve first pressure chambers 221, which are aligned in the sheet feeding direction, constitute a first pressure chamber array $L_{221}$, and the twelve second pressure chambers 222, which are aligned in the sheet feeding direction, constitute a second pressure chamber array $L_{222}$.

The first descender channel 231 and the second descender channel 232 are formed by coaxially providing circular through-holes through the plates 20B to 20G respectively. The first descender channel 231 extends downwardly from the first pressure chamber 221, and the second descender channel 232 extends downwardly from the second pressure chamber 222.

The connecting channel 24 is formed by removing a part of the plate 20G. The connecting channel 24 connects the lower end portion of the first descender channel 231 and the lower end portion of the second descender channel 232.

The nozzle 25 is formed through the plate 20H at a substantially central portion of the connecting channel 24. The twelve nozzles 25, which are aligned in the sheet feeding direction, constitute a nozzle array $L_{25}$.

In FIG. 6, the individual channel ICH2, which is included in the individual channel array $L_{ICH2}$ disposed as an odd number array as counted from the left, is arranged so that the first pressure chamber array $L_{221}$ is positioned on the left side and the second pressure chamber array $L_{222}$ is positioned on the right side. On the other hand, the individual channel ICH2, which is included in the individual channel array $L_{ICH2}$ disposed as an even number array as counted from the left, is arranged so that the second pressure chamber array $L_{222}$ is positioned on the left side and the first pressure chamber array $L_{221}$ is positioned on the right side.

The four supply ports PI2 and the three recovery ports PO2 are arranged alternately in the sheet width direction in the vicinity of the end portion of the channel unit 20 on the sheet supply side in the sheet feeding direction. As depicted in FIG. 7, each of the four supply ports PI2 and the three recovery ports PO2 is formed by coaxially providing through-holes through the plates 20A to 20C respectively. Each of the supply ports PI2 is connected to the ink supply channel 701 on the upper side, and each of the supply ports PI2 is connected to the supply manifold channel MI2 on the lower side. Each of the recovery ports PO2 is connected to the ink recovery channel 702 on the upper side, and each of the recovery ports PO2 is connected to the return manifold channel MO2 on the lower side.

A filter F, which avoids any passage of any foreign matter or the like contained in the ink, is provided at the connecting portion between each of the supply ports PI2 and the ink supply channel 701 and at the connecting portion between each of the recovery ports PO2 and the ink recovery channel 702.

Each of the four supply manifold channels MI2 is formed by removing parts of the plates 20D, 20E, 20F. The supply manifold channel MI2 extends linearly in the sheet feeding direction from the upstream end MI2*a* to the downstream end MI2*b*.

The upstream end MI2*a* of the supply manifold channel MI2 is positioned on the upstream side as compared with the individual channel ICH2 which is disposed on the most upstream side and which is included in the plurality of individual channels ICH2 for constructing the corresponding individual channel array $L_{ICH2}$. The upstream end MI2*a* of the supply manifold channel MI2 is connected to the supply port PI2. The downstream end MI2*b* of the supply manifold channel MI2 is positioned on the downstream side as compared with the individual channel ICH2 which is disposed on the most downstream side and which is included in the plurality of individual channels ICH2 for constructing the corresponding individual channel array $L_{ICH2}$.

The upper surface MI2*u* of the supply manifold channel MI2 is formed by the lower surface of the plate 20C. The first throttle channels 211 of the plurality of individual channels ICH2 of the corresponding individual channel array $L_{ICH2}$ are connected at equal intervals to the upper surface MI2*u* while being aligned in the extending direction of the supply manifold channel MI2.

As depicted in FIG. 6, as for the two supply manifold channels MI2 positioned at the both end portions in the sheet width direction, the first throttle channels 211 of the plurality of individual channels ICH2 of the individual channel array $L_{ICH2}$ positioned on one side thereof are connected while being aligned in the sheet feeding direction. As for the two supply manifold channels MI2 positioned at the central portions in the sheet width direction, the first throttle channels 211 of the plurality of individual channels ICH2 of the individual channel array $L_{ICH2}$ positioned on the both sides thereof are connected in a zigzag form in the sheet feeding direction.

A tapered area TA, in which the width of the channel is gradually narrowed at positions disposed on the more downstream side, is provided in the area disposed in the vicinity of the downstream end MI2*b* of the supply manifold channel MI2, i.e., in the area disposed on the downstream side as compared with the individual channel ICH2 which is positioned on the most downstream side and which is included in the plurality of individual channels ICH2 connected to the supply manifold channel MI2. One or two upstream end(s) B2*a* of the bypass channel B2 is/are connected to the upper surface MI2*u* (as described later on) on the most downstream side of the tapered area TA, i.e., at the position at which the width of the channel is narrowest.

The return manifold channel MO2 is formed by removing parts of the plates 20D, 20E, 20F. The return manifold channel MO2 extends linearly in the sheet feeding direction from the upstream end MO2*a* to the downstream end MO2*b*.

The upstream end MO2*a* of the return manifold channel MO2 is positioned on the upstream side as compared with the individual channel ICH2 which is disposed on the most upstream side and which is included in the plurality of individual channels ICH2 for constructing the corresponding individual channel array $L_{ICH2}$. The downstream end MO2*b* of the return manifold channel MO2 is positioned on the downstream side as compared with the individual channel ICH2 which is disposed on the most downstream side and which is included in the plurality of individual channels ICH2 for constructing the corresponding individual channel array $L_{ICH2}$. The downstream end MO2*b* of the return manifold channel MO2 is connected to the recovery port PO2.

The upper surface MO2*u* of the return manifold channel MO2 is formed by the lower surface of the plate 20C. The second throttle channels 212 of the plurality of individual channels ICH2 of the individual channel array $L_{ICH2}$ positioned on the both sides of the return manifold channel MO2 are connected to the upper surface MO2*u* in a zigzag form in the extending direction of the return manifold channel MO2 (FIG. 6).

A tapered area TA, in which the width of the channel is gradually narrowed at positions disposed on the more upstream side, is provided in the area disposed in the vicinity of the upstream end MO2*a* of the return manifold channel MO2, i.e., in the area disposed on the upstream side as compared with the individual channel ICH2 which is positioned on the most upstream side and which is included in the plurality of individual channels ICH2 connected to the return manifold channel MO2. Two downstream ends B2*b* of the bypass channel B2 are connected to the upper surface MO2*u* (as described later on) on the most upstream side of the tapered area TA, i.e., at the position at which the width of the channel is narrowest.

Recesses are formed on the upper surface of the plate 20G, and the plate 20G is thinned under the supply manifold channels MI2 and under the return manifold channels MO2. Accordingly, a damper chamber DR2 is defined between the plate 20F and the plate 20G. When the damper chamber DR2 is provided, the plate 20F for constructing the lower surfaces of the supply manifold channels MI2 and the lower surfaces of the return manifold channels MO2 can be thereby deformed. Owing to the deformation of the plate 20F, the pressure fluctuation of the ink is suppressed in the supply manifold channels MI2 and in the return manifold channels MO2.

Figure 8:
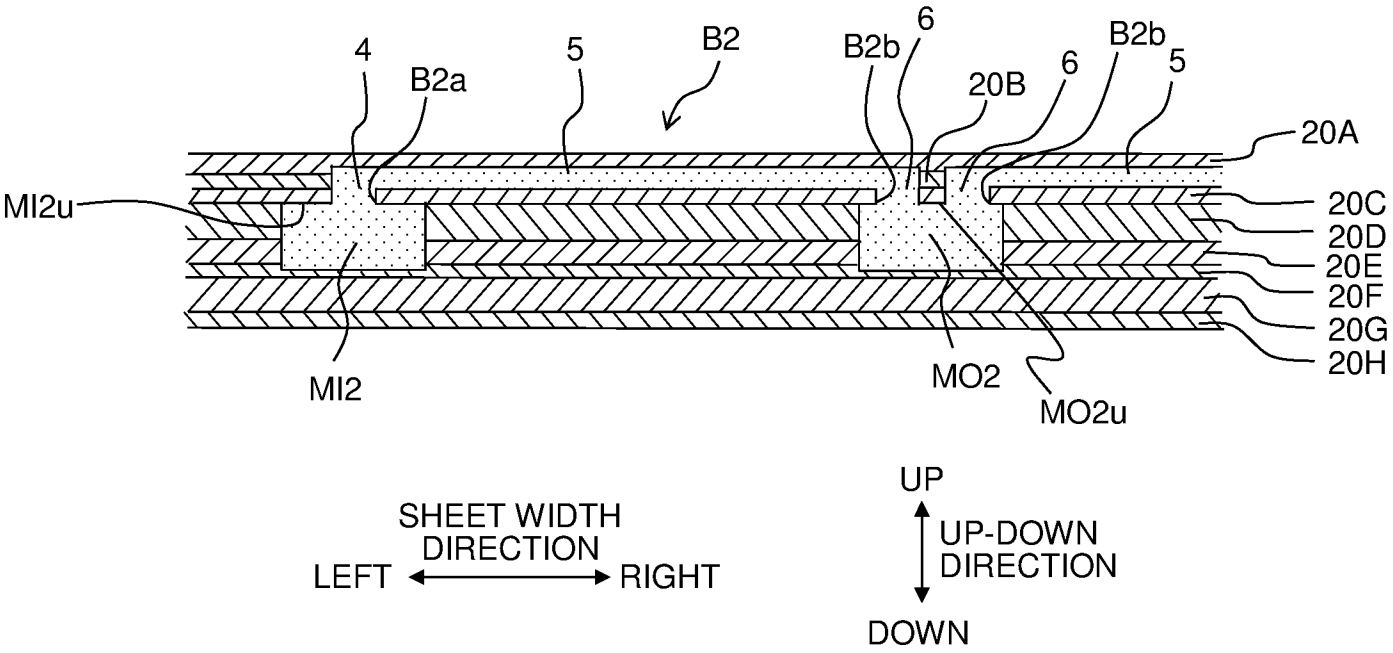
FIG. 8 is a sectional view taken along a line VIII-VIII depicted in FIG. 6.

Each of the six bypass channels B2 includes an inflow channel 4, a connecting channel 5, and an outflow channel 6 along with the flow of the ink from the upstream side to the downstream side (FIG. 8).

The inflow channel 4 extends upwardly from the downstream end MI2*b* of the supply manifold channel MI2. The inflow channel 4 is formed by removing parts of the plates 20A to 20C. The upstream end of the inflow channel 4 is the upstream end B2*a* of the bypass channel B2.

The connecting channel 5 is a channel which connects the inflow channel 4 and the outflow channel 6. The connecting channel 5 is formed by removing parts of the plate 20A and the plate 20B. The connecting channel 5 extends in the sheet width direction. The connecting channel 5 is connected to the upper end (downstream end) of the inflow channel 4 at the upstream end, and the connecting channel 5 is connected to the upper end (upstream end) of the outflow channel 6 at the downstream end.

The outflow channel 6 is a channel which extends downwardly from the downstream end of the connecting channel 5 and which is connected to the upstream end MO2*a* of the return manifold channel MO2. The outflow channel 6 is formed by removing parts of the plates 20A to 20C. The downstream end of the outflow channel 6 is the downstream end B2*b* of the bypass channel B2.

The cross-sectional shape of the bypass channel B2, which is taken along the plane that is orthogonal to the extending direction of the bypass channel B2, is, for example, circular at the portion where the bypass channel B2 extends in the up-down direction, and the cross-sectional shape is rectangular or square at the portion where the bypass channel B2 extends in the sheet width direction. Further, as for the dimension of the cross-sectional shape, for example, the diameter is about 50 μm to 200 μm at the portion at which the cross-sectional shape is circular, and one side is about 50 μm to 200 μm at the portion at which the cross-sectional shape is rectangular or square. Note that in FIG. 8, the height of the cross-sectional shape of the connecting channel 5 is smaller than the diameters of the cross-sectional shapes of the inflow channel 4 and the outflow channel 6. However, there is no limitation thereto. For example, the height of the cross-sectional shape of the connecting channel 5 may be larger than the diameter of the cross-sectional shape of the inflow channel 4 and/or the outflow channel 6. Alternatively, the diameters (heights) of the cross-sectional shapes of the inflow channel 4, the connecting channel 5, and the outflow channel 6 may be identical with each other.

The channel length between the upstream end B2*a* and the downstream end B2*b* of the bypass channel B2 is, for example, about 1000 μm to 2000 μm.

In FIG. 6, the bypass channel B2 having an odd number as counted from the left is arranged so that the inflow channel 4 is positioned on the left side and the outflow channel 6 is positioned on the right side (arranged so that the ink flows from the left to the right as viewed in a plan view of FIG. 6). On the other hand, the bypass channel B2 having an even number as counted from the left is arranged so that the outflow channel 6 is positioned on the left side and the inflow channel 4 is positioned on the right side (arranged so that the ink flows from the right to the left as viewed in a plan view of FIG. 6). That is, each of the bypass channels B2 is arranged while being reversed in relation to every array so that the upstream end B2*a* of the bypass channel B2 is connected to the supply manifold channel MI2 and the downstream end B2*b* of the bypass channel B2 is connected to the return manifold channel MO2 in the same manner as the individual channel ICH2.

Figure 9A:
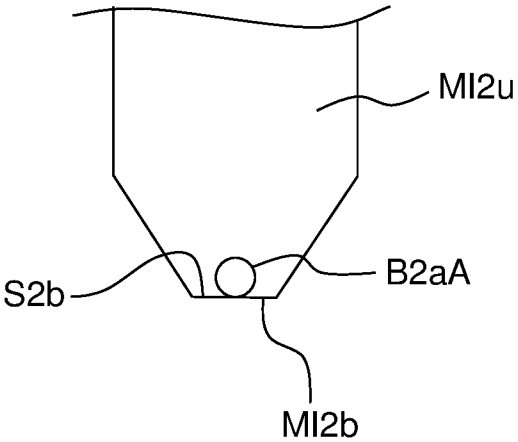
FIGS. 9A and 9B are plan views depicting connecting portions of a bypass channel with respect to a supply manifold channel of the second embodiment.
Figure 9B:
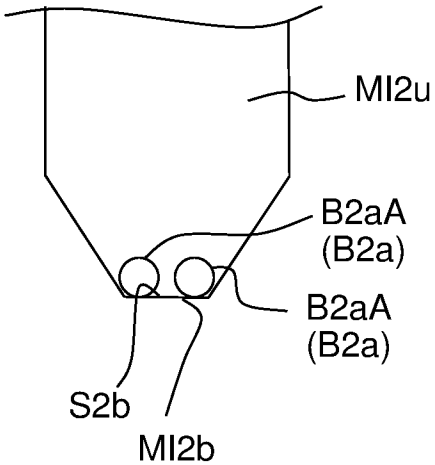
Figure 9C:
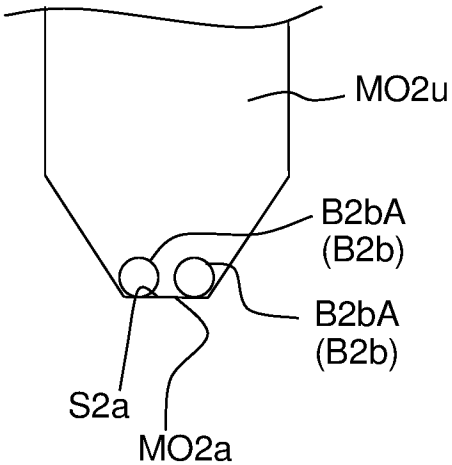
FIG. 9C is a plan view depicting a connecting portion of the bypass channel with respect to a return manifold channel of the second embodiment.

With reference to FIG. 6, only one bypass channel B2 is connected to the supply manifold channel MI2 positioned at both end portions in the sheet width direction (FIG. 9A), and the two bypass channels B2 positioned on the both sides are connected to the other supply manifold channel MI2 (FIG. 9B). The two bypass channels B2 positioned on the both sides are connected to the return manifold channel MO2 (FIG. 9C). As for the supply manifold channel MI2 to which the two bypass channels B2 are connected, the upstream ends B2*a* of the two bypass channels B2 are aligned in the sheet width direction (FIG. 9B). As for the return manifold channel MO2 to which the two bypass channels B2 are connected, the downstream ends B2*b* of the two bypass channels B2 are aligned in the sheet width direction (FIG. 9C).

The upstream end B2*a* of the bypass channel B2 is connected to the upper surface MI2*u* of the supply manifold channel MI2 at the downstream end MI2*b* of the supply manifold channel MI2 to define a circular opening B2*a*A (FIG. 9A). The opening B2*a*A is brought in contact with the end surface S2*b* positioned at the downstream end MI2*b* of the supply manifold channel MI2. That is, the portion of the circumferential surface of the inflow channel 4, which is positioned on the most downstream side of the supply manifold channel MI2, is flush with the side surface S2*b* of the supply manifold channel MI2 on the downstream side.

The downstream end B2*b* of the bypass channel B2 is connected to the upper surface MO2*u* of the return manifold channel MO2 at the upstream end MO2*a* of the return manifold channel MO2 to define a circular opening B2*b*A (FIG. 9C). The opening B2*b*A is brought in contact with the end surface S2*a* positioned at the upstream end MO2*a* of the return manifold channel MO2. That is, the portion of the circumferential surface of the outflow channel 6, which is positioned on the most upstream side of the return manifold channel MO2, is flush with the end surface S2*a* of the return manifold channel MO2 on the upstream side.

The channel resistance of the bypass channel B2 constructed as described above is smaller than about 12 kpa·s/cc assuming that the viscosity of the liquid flowing inside the channel is 1 cps. Note that the channel resistance of the individual channel ICH2 is about $11\times10^3$ to $13\times10^3$ kpa·s/cc, which is about 1000 times the channel resistance of the bypass channel B2, assuming that the viscosity of the liquid flowing inside the channel is 1 cps. The channel resistance of the bypass channel B2 may be not more than 1/500 of the channel resistance of the individual channel ICH2, and the channel resistance of the bypass channel B2 may be not more than 1/1000 of the channel resistance of the individual channel ICH2.

Further, the channel resistances of the supply manifold channel MI2 and the return manifold channel MO2 are about 2 to 4 kpa·s/cc assuming that the viscosity of the liquid flowing inside the channel is 1 cps. The channel resistance of the bypass channel B2 is about three times to six times the channel resistances of the supply manifold channel MI2 and the return manifold channel MO2.

<Piezoelectric Actuator 60>

The piezoelectric actuator 60 is constructed in approximately the same manner as the piezoelectric actuator 50 of the first embodiment. The piezoelectric actuator 60 is provided with a first piezoelectric layer 61, a second piezoelectric layer 62, a common electrode 63, and individual electrodes 64.

The plurality of individual electrodes 64 are provided on the upper surface of the second piezoelectric layer 62 so that the plurality of individual electrodes 64 are positioned respectively over or above the first and second pressure chambers 221, 222 of the plurality of individual channels ICH2 (FIG. 6).

When the ink is discharged from a desired nozzle 25, the driver IC (not depicted) applies the driving electric potential to the two individual electrodes 64 corresponding to the first pressure chamber 221 and the second pressure chamber 222 (referred to as "target pressure chambers") included in the individual channel ICH2 including the desired nozzle. As a result, the volumes of the two target pressure chambers are decreased and the pressure of the ink contained therein is raised in accordance with the action which is the same as or equivalent to that of the piezoelectric actuator 50 of the first embodiment. The liquid droplets of the ink are discharged from the nozzle 25 communicated with the first and second pressure chambers 221, 222 via the first and second descender channels 231, 232.

<Image Forming Method>

The image formation on the sheet P, which is based on the use of the printer 2000 and the ink-jet head 120, is also performed in the same manner as the image formation on the sheet P which is based on the use of the printer 1000 and the ink-jet head 110 of the first embodiment.

The printer 2000 maintains the circulation of the ink (hereinafter simply referred to as "ink circulation") along the circulating channel CC2 from the subtank 600 via the ink supply channel 701, the supply manifold channel MI2, the bypass channel B2 or the individual channel ICH2, the return manifold channel MO2, and the ink recovery channel 702 to return to the subtank 600 by means of the pump 800 even in the period in which the ink is not discharged by the ink-jet head 120, in the same manner as the printer 1000.

<Discharge of Bubbles by Bypass Channel>

Next, an explanation will be made about the discharge of bubbles by using the bypass channel B2 of this embodiment.

In the case of the ink-jet head 120 of this embodiment, the bypass channel B2, which has the channel resistance smaller than that of the individual channel ICH2 (about 1/1000), is connected to the downstream end of the supply manifold channel MI2. Therefore, most of the ink flowing through the supply manifold channel MI2 in accordance with the ink circulation flows into the bypass channel B2, and the ink flows to the return manifold channel MO2 while detouring the individual channel ICH2. Owing to this flow, the bubbles are discharged from the supply manifold channel MI2.

In particular, in the case of the ink-jet head 120 of this embodiment, the upstream end B2*a* of the bypass channel B2 is also connected to the upper surface MI2*u* of the supply manifold channel MI2 to which the individual channels ICH2 are connected. The ink, which flows through the supply manifold channel MI2 in accordance with the ink circulation, has the flow rate which is especially increased in the vicinity of the upper surface MI2*u* to which the upstream end B2*a* of the bypass channel B2 is connected. Therefore, the bubbles, which exist in the vicinity of the upper surface MI2*u* of the supply manifold channel MI2, are discharged especially quickly. The individual channel ICH2, which is connected to the upper surface MI2*u*, is reliably suppressed from the contamination with the bubbles.

This feature is especially advantageous in this embodiment in which the individual channel ICH2 is connected to the upper surface MI2*u* of the supply manifold channel MI2. The bubbles, with which the supply manifold channel MI2 is contaminated, stay in the vicinity of the upper surface MI2*u* on account of the buoyancy. Therefore, the bubbles tend to enter the individual channel ICH2 connected to the upper surface MI2*u*, for example, as compared with any individual channel connected to the lower surface of the supply manifold channel MI2. However, the bubbles, which exist in the vicinity of the upper surface MI2*u* of the supply manifold channel MI2, are quickly discharged, and the individual channel ICH2 connected to the upper surface MI2*u* is suppressed from the contamination with the bubbles by increasing the flow rate of the ink in the vicinity of the upper surface MI2*u* by connecting the upstream end B2*a* of the bypass channel B2 to the upper surface MI2*u* of the supply manifold channel MI2 to which the individual channel ICH2 is connected, as performed in this embodiment.

Further, the ink-jet head 120 of this embodiment has the tapered portion TA, and the channel resistance of the bypass channel B2 is larger than the channel resistance of the supply manifold channel MI2 (about three to six times). Therefore, the bubbles are sent into the bypass channel B2 more reliably in accordance with the acceleration of the ink, in the same manner as the ink-jet head 110 of the first embodiment. The portion of the circumferential surface of the inflow channel 4 of the bypass channel B2, which is positioned on the most downstream side of the supply manifold channel MI2, is flush with the end surface S2*b* disposed on the downstream side of the supply manifold channel MI2. Therefore, the bubbles are suppressed from staying at the step portion as well.

Further, in the ink-jet head 120 of this embodiment, the bypass channel B2, which has the channel resistance larger than that of the return manifold channel MO2 (about three to six times), is connected to the upstream end of the return manifold channel MO2. Therefore, the bubbles contained in the return manifold channel MO2 are allowed to flow to the ink recovery channel 702 by the ink which outflows from the bypass channel B2 at the large flow rate.

In particular, in the case of the ink-jet head 120 of this embodiment, the downstream end B2*b* of the bypass channel B2 is also connected to the upper surface MO2*u* of the return manifold channel MO2 to which the individual channel ICH2 is connected. The ink, which flows through the return manifold channel MO2 in accordance with the ink circulation, has the flow rate which is especially increased in the vicinity of the upper surface MO2*u* to which the downstream end B2*b* of the bypass channel B2 is connected. Therefore, the bubbles, which exist in the vicinity of the upper surface MO2*u* of the return manifold channel MO2, are discharged especially quickly. The individual channel ICH2, which is connected to the upper surface MO2*u*, is more reliably suppressed from the contamination with the bubbles.

Note that the return manifold channel MO2 is disposed on the downstream side of the individual channel ICH2. However, when the ink flows into each of the individual channels ICH2 after the discharge of the ink, the ink contained in the return manifold channel MO2 flows in some cases to the second pressure chamber 222 via the second throttle channel 212. On this account, this embodiment is provided with the structure which also makes it possible to suppress the contamination with the bubbles from the return manifold channel MO2.

Main effects of the ink-jet head 120 and the printer 2000 of this embodiment are summarized below.

The ink-jet head 120 of this embodiment is provided with the bypass channel B2 which connects the supply manifold channel MI2 and the return manifold channel MO2 while detouring the individual channel ICH2 and which has the channel resistance smaller than that of the individual channel. Therefore, most of the bubbles, with which the ink contained in the supply manifold channel MI2 is contaminated, can be quickly discharged via the bypass channel B2. In particular, the connecting portion of the bypass channel B2 with respect to the supply manifold channel MI2 is the upper surface MI2*u* of the supply manifold channel MI2. Therefore, the flow rate of the ink, which is provided in the supply manifold channel MI2, is especially increased in the vicinity of the upper surface MI2*u*. The individual channel ICH2, which is connected to the upper surface MI2*u* as well, can be more reliably suppressed from the contamination with the bubbles.

The ink-jet head 120 of this embodiment is provided with the bypass channel B2 which connects the supply manifold channel MI2 and the return manifold channel MO2. On this account, the bubbles, with which the ink contained in the return manifold channel MO2 is contaminated, can be washed away to the ink recovery channel 702 by means of the ink which outflows from the bypass channel B2. In particular, the connecting portion of the bypass channel B2 with respect to the return manifold channel MO2 is the upper surface MO2*u* of the return manifold channel MO2. Therefore, the flow rate of the ink, which is provided in the return manifold channel MO2, is especially increased in the vicinity of the upper surface MO2*u*. The individual channel ICH2, which is connected to the upper surface MO2*u* as well, can be more reliably suppressed from the contamination with the bubbles.

The printer 2000 of this embodiment can perform the satisfactory image formation by using the ink which is retained in the satisfactory state by the ink-jet head 120 of this embodiment.

Third Embodiment

An explanation will be made about an ink-jet head (liquid discharge apparatus) 130 and a printer (image recording apparatus) 3000 of a third embodiment of the present disclosure.

The printer 3000 (FIG. 1) is the same as the image recording apparatus 1000 of the first embodiment except that the printer 3000 is provided with the ink-jet head 130 in place of the ink-jet head 110. In the following description, only the ink-jet head 130 will be explained.

<Ink-Jet Head 130>

The ink-jet head 130 comprises a channel unit (channel member) 30 which is formed with channel CH3 in order that the ink coming from a subtank 600 is discharged while being distributed to appropriate positions, and a plurality of piezoelectric actuators 70 which are arranged at the inside of the channel unit 30.

The channel unit 30 has a stacked structure in which a discharge plate 30A, a first plate 30B, a vibration plate 30C, a second plate 30D, a third plate 30E, a fourth plate 30F, and a manifold plate 30G are stacked in this order from the bottom. The channel CH3 and accommodating space R for arranging the plurality of piezoelectric actuators 70 are formed by removing parts of the respective plates. The vibration plate 30C includes an elastic film 30C1 and an insulator film 30C2.

Figure 10:
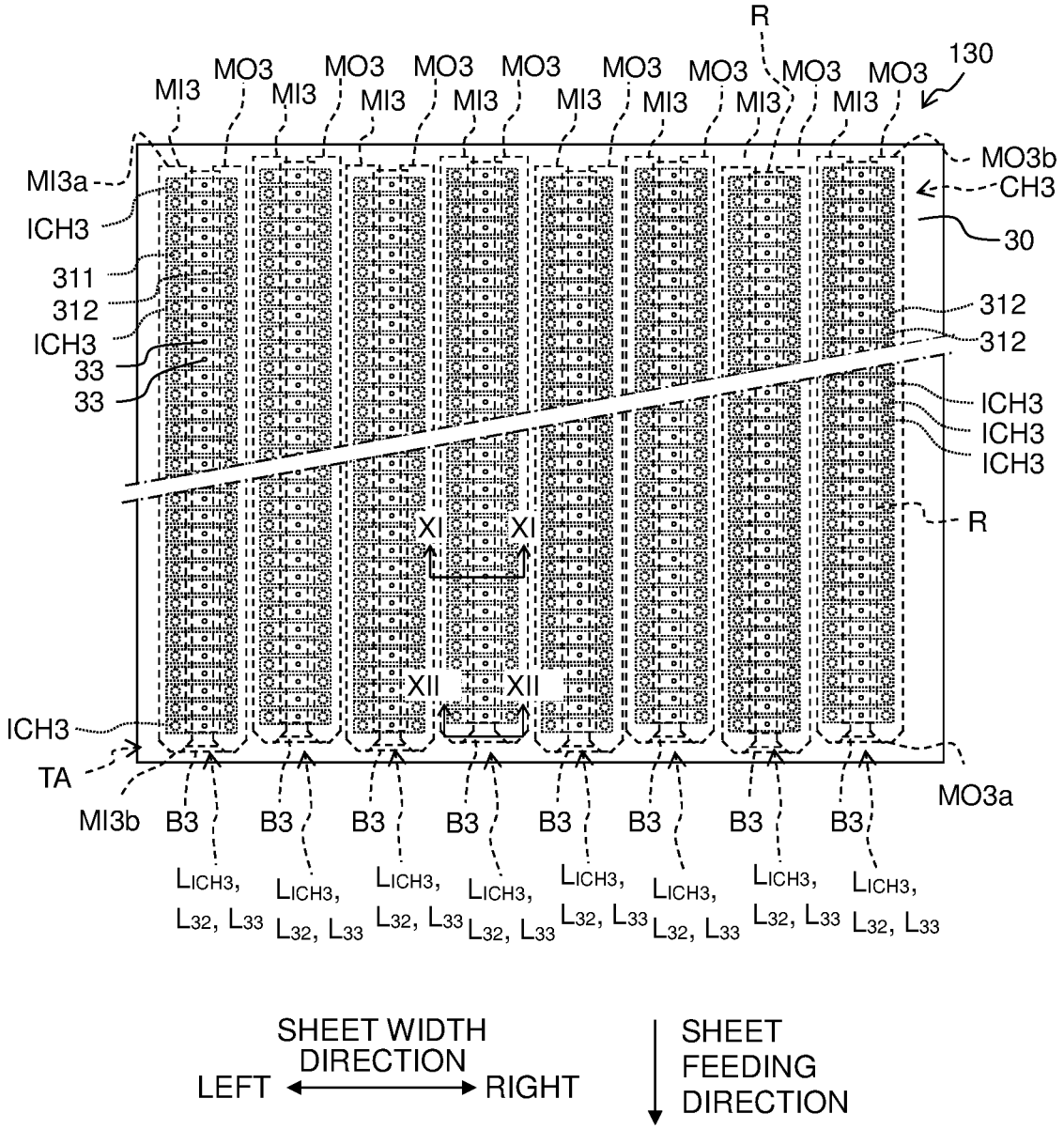
FIG. 10 is a schematic plan view depicting an ink-jet head of a third embodiment.
Figure 11:
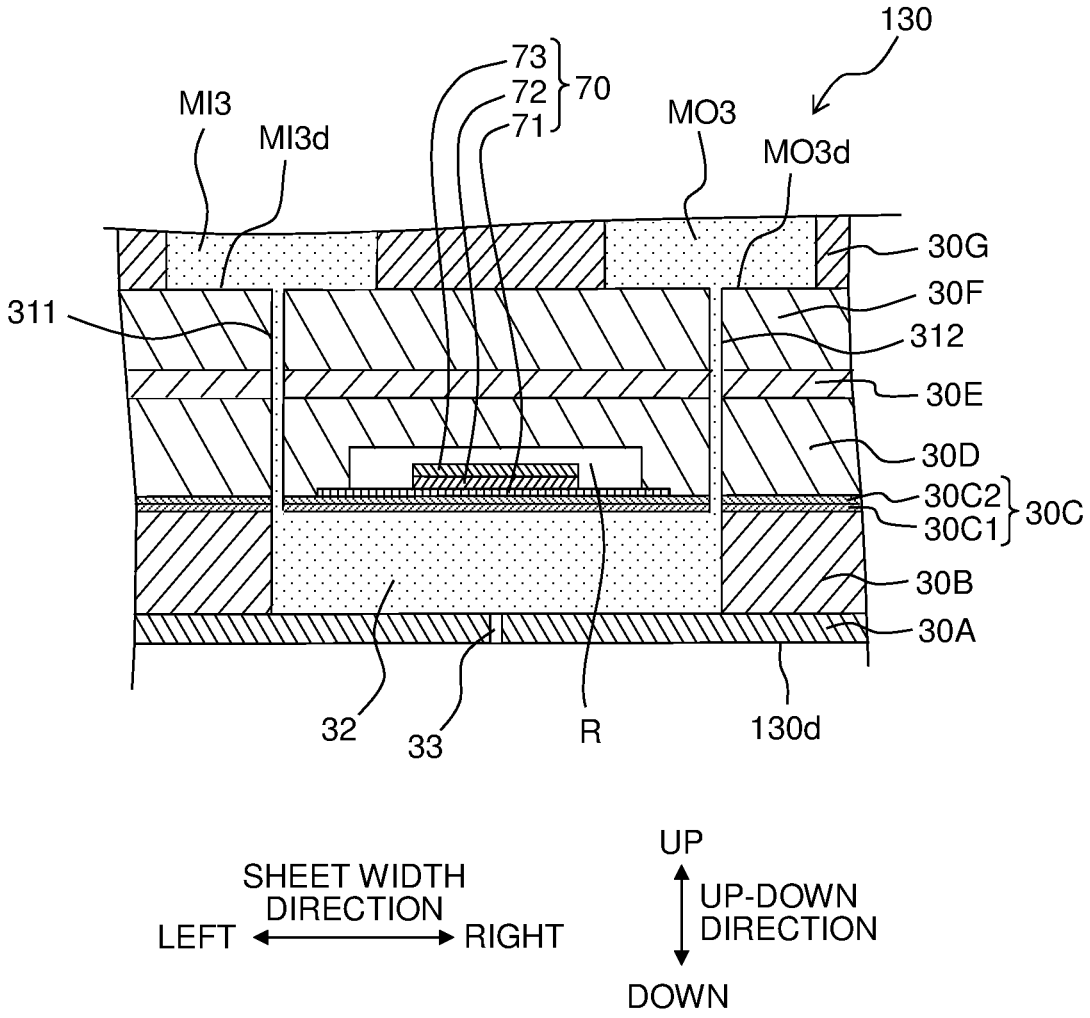
FIG. 11 is a sectional view taken along a line XI-XI depicted in FIG. 10.

As depicted in FIGS. 10 and 11, the channels CH3 mainly include a plurality of individual channels ICH3 which are arranged in the sheet feeding direction and the sheet width direction, supply manifold channels (first manifold channels) MI3 which distribute the ink supplied from the subtank 600 to the plurality of individual channels ICH3, and return manifold channels (second manifold channels) MO3 which merge the ink from the plurality of individual channels ICH3 to return the ink to the subtank 600.

The individual channels ICH3 are aligned in the sheet feeding direction to construct individual channel arrays $L_{ICH3}$. The supply manifold channel MI3 and the return manifold channel MO3 are provided one by one with respect to one individual channel array $L_{ICH3}$. In this embodiment, eight arrays of the individual channel arrays $L_{ICH3}$ are formed in the sheet width direction. Eight manifold channels MI3 and eight return manifold channels MO3 are formed respectively. Further, eight bypass channels B3 are formed to connect the supply manifold channels MI3 and the return manifold channels MO3 while detouring the individual channels ICH3.

Each of the plurality of individual channels ICH3 includes a first communication channel (a first connection channel) 311, a pressure chamber 32, a nozzle 33, and a second communication channel (a second connection channel) 312 as referred to in this order from the upstream side to the downstream side of the flow of the ink.

The first communication channel 311 and the second communication channel 312 are channels which extend upwardly and downwardly while penetrating through the vibration plate 30C, the second plate 30D, the third plate 30E, and the fourth plate 30F. The first communication channel 311 is connected to the lower surface MI3*d* of the supply manifold channel MI3 at the upstream end (upper end), and the first communication channel 311 is connected to the upper surface of the pressure chamber 32 at the downstream end (lower end). The second communication channel 312 is connected to the upper surface of the pressure chamber 32 at the upstream end (lower end), and the second communication channel 312 is connected to the lower surface MO3*d* of the return manifold channel MO3 at the downstream end (upper end).

The first and second communication channels 311, 312 are constructed so that the large channel resistance is provided by decreasing the channel cross-sectional area and increasing the channel length. Accordingly, when the pressure is applied to the pressure chamber 32 (as described later on), the occurrence of any massive flow of the ink directed from the pressure chamber 32 to the supply manifold channel MI3 and the return manifold channel MO3 is suppressed.

The pressure chamber 32 is a space for applying the pressure brought about by the piezoelectric actuator 70 to the ink. The pressure chamber 32 is formed by removing a part of the first plate 30B. The upper surface of the pressure chamber 32 is formed by the elastic film 30C1 of the vibration plate 30C.

The shape of the pressure chamber 32, which is viewed in a plan view, is a substantially rectangular shape which is long in the sheet width direction. The first communication channel 311 is connected to the portion disposed in the vicinity of one short side, and the second communication channel 312 is connected to the portion disposed in the vicinity of the other short side. The pressure chambers 32, which are aligned in the sheet feeding direction, constitute the pressure chamber array $L_{32}$.

The nozzle 33 is formed in the discharge plate 30A at a substantially central portion of the pressure chamber 32 as viewed in a plan view. The nozzles 33, which are aligned in the sheet feeding direction, constitute the nozzle array $L_{33}$. The lower surface of the discharge plate 30A, on which the nozzles 33 and the nozzle arrays $L_{33}$ are formed, is the lower surface 130*d* of the ink-jet head 130.

The eight supply manifold channels MI3 are formed by removing parts of the manifold plate 30G respectively. The supply manifold channel MI3 extends linearly in the sheet feeding direction from the upstream end MI3*a* to the downstream end MI3*b*.

The upstream end MI3*a* of the supply manifold channel MI3 is positioned on the upstream side as compared with the individual channel ICH3 which is disposed on the most upstream side and which is included in the plurality of individual channels ICH3 for constructing the corresponding individual channel array $L_{ICH3}$, and the upstream end MI3*a* is connected to the ink supply channel 701 via an undepicted channel. The downstream end MI3*b* of the supply manifold channel MI3 is positioned on the downstream side as compared with the individual channel ICH3 which is disposed on the most downstream side and which is included in the plurality of individual channels ICH3 for constructing the corresponding individual channel array $L_{ICH3}$.

The lower surface MI3*d* of the supply manifold channel MI3 is formed by the upper surface of the fourth plate 30F. The first communication channels 311 of the plurality of individual channels ICH3 of the corresponding individual channel array $L_{ICH3}$ are connected at equal intervals to the lower surface MI3*d* while being aligned in the extending direction of the supply manifold channel MI3.

A tapered area TA, in which the width of the channel is gradually narrowed at positions disposed on the more downstream side, is provided in the area disposed in the vicinity of the downstream end MI3*b* of the supply manifold channel MI3, i.e., in the area disposed on the downstream side as compared with the individual channel ICH3 which is positioned on the most downstream side and which is included in the plurality of individual channels ICH3 connected to the supply manifold channel MI3. The upstream end B3*a* of the bypass channel B3 is connected to the lower surface MI3*d* (as described later on) on the most downstream side of the tapered area TA, i.e., at the position at which the width of the channel is narrowest.

Each of the eight return manifold channels MO3 is formed by removing a part of the manifold plate 30G. The return manifold channel MO3 extends linearly in the sheet feeding direction from the upstream end MO3*a* to the downstream end MO3*b*.

The upstream end MO3*a* of the return manifold channel MO3 is positioned on the upstream side as compared with the individual channel ICH3 which is disposed on the most upstream side and which is included in the plurality of individual channels ICH3 for constructing the corresponding individual channel array $L_{ICH3}$. The downstream end MO3*b* of the return manifold channel MO3 is positioned on the downstream side as compared with the individual channel ICH3 which is disposed on the most downstream side and which is included in the plurality of individual channels ICH3 for constructing the corresponding individual channel array $L_{ICH3}$. The downstream end MO3*b* is connected to the ink recovery channel 702 via an undepicted channel.

The lower surface MO3*d* of the return manifold channel MO3 is formed by the upper surface of the fourth plate 30F. The second communication channels 312 of the plurality of individual channels ICH3 of the corresponding individual channel array $L_{ICH3}$ are connected at equal intervals to the lower surface MO3*d* while being aligned in the extending direction of the return manifold channel MO3.

A tapered area TA, in which the width of the channel is gradually narrowed at positions disposed on the more upstream side, is provided in the area disposed in the vicinity of the upstream end MO3*a* of the return manifold channel MO3, i.e., in the area disposed on the upstream side as compared with the individual channel ICH3 which is positioned on the most upstream side and which is included in the plurality of individual channels ICH3 connected to the return manifold channel MO3. The downstream end of the bypass channel B3 is connected to the lower surface MO3*d* on the most upstream side of the tapered area TA, i.e., at the position at which the width of the channel is narrowest.

Figure 12:
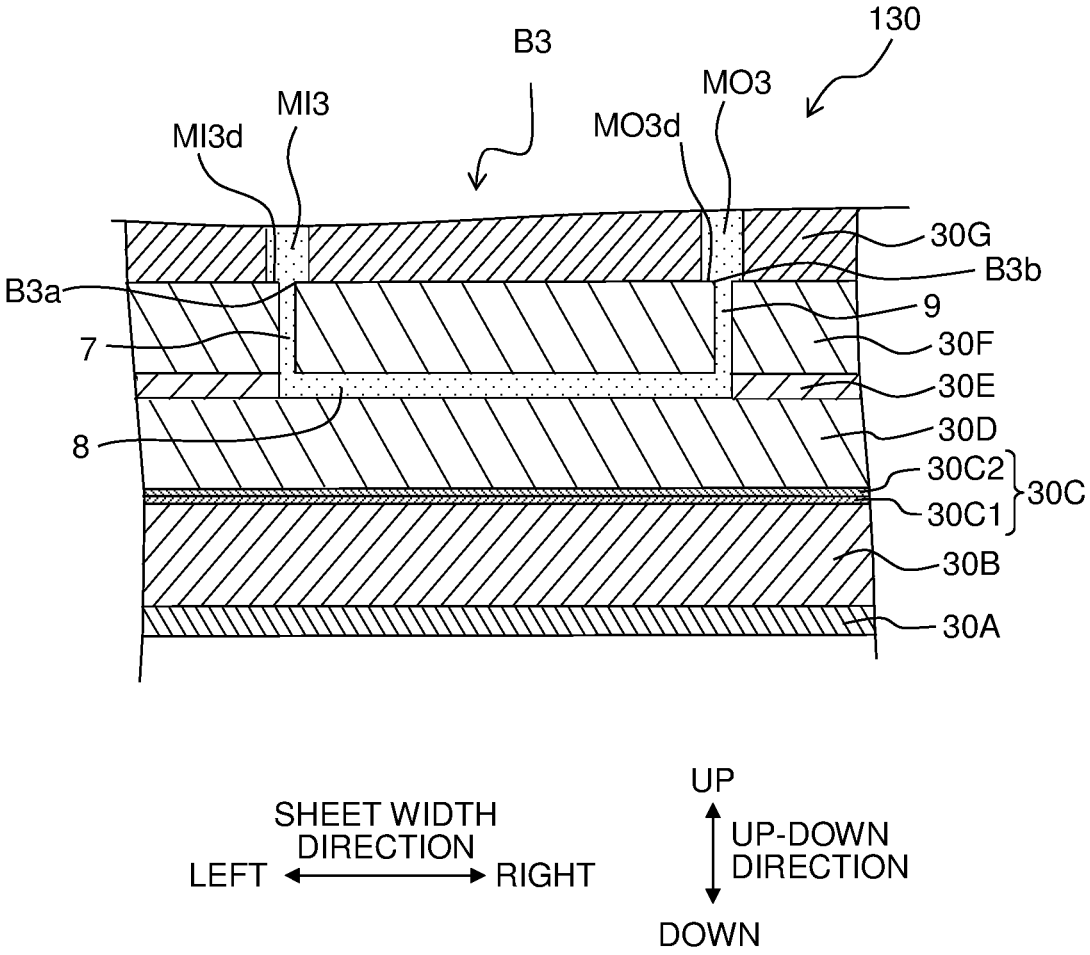
FIG. 12 is a sectional view taken along a line XII-XII depicted in FIG. 10.

Each of the eight bypass channels B3 includes an inflow channel 7, a connecting channel 8, and an outflow channel 9 along with the flow of the ink from the upstream side to the downstream side (FIG. 12).

The inflow channel 7 extends downwardly from the downstream end MI3*b* of the supply manifold channel MI3. The inflow channel 7 is formed by removing parts of the third plate 30E and the fourth plate 30F. The upstream end of the inflow channel 7 is the upstream end B3*a* of the bypass channel B3.

The connecting channel 8 is a channel which connects the inflow channel 7 and the outflow channel 9. The connecting channel 8 is formed by removing a part of the third plate 30E. The connecting channel 8 extends in the sheet width direction. The connecting channel 8 is connected to the lower end (downstream end) of the inflow channel 7 at the upstream end, and the connecting channel 8 is connected to the lower end (upstream end) of the outflow channel 9 at the downstream end.

The outflow channel 9 is a channel which extends upwardly from the downstream end of the connecting channel 8 and which is connected to the return manifold channel MO3. The outflow channel 9 is formed by removing parts of the third plate 30E and the fourth plate 30F. The downstream end of the outflow channel 9 is the downstream end B3*b* of the bypass channel B3.

The cross-sectional shape of the bypass channel B3, which is taken along the plane that is orthogonal to the extending direction of the bypass channel B3, is, for example, circular at the portion where the bypass channel B3 extends in the up-down direction, and the cross-sectional shape is rectangular or square at the portion where the bypass channel B3 extends in the sheet width direction. Further, as for the dimension of the cross-sectional shape, for example, the diameter is about 50 μm to 200 μm at the portion at which the cross-sectional shape is circular, and one side is about 50 μm to 200 μm at the portion at which the cross-sectional shape is rectangular or square. Note that in FIG. 12, the height of the cross-sectional shape of the connecting channel 8 is larger than the diameters of the cross-sectional shapes of the inflow channel 7 and the outflow channel 9. However, there is no limitation thereto. For example, the height of the cross-sectional shape of the connecting channel 8 may be smaller than the diameter of the cross-sectional shape of the inflow channel 7 and/or the outflow channel 9. Alternatively, the diameters (heights) of the cross-sectional shapes of the inflow channel 7, the connecting channel 8, and the outflow channel 9 may be identical with each other.

The channel length between the upstream end B3*a* and the downstream end B3*b* of the bypass channel B3 is, for example, about 1000 μm to 2000 μm.

Figure 13B:
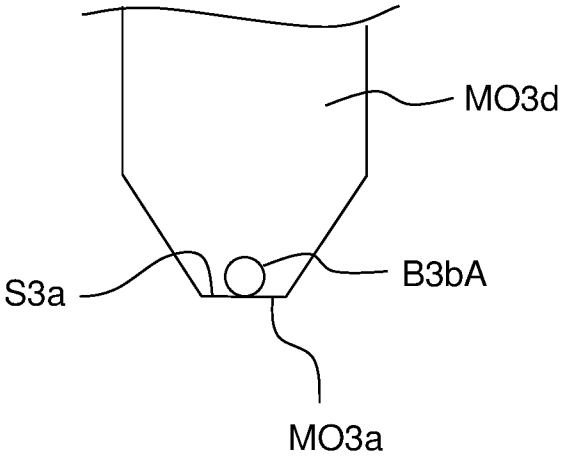
FIG. 13B is a plan view depicting a connecting portion of the bypass channel with respect to a return manifold channel of the third embodiment.
Figure 13A:
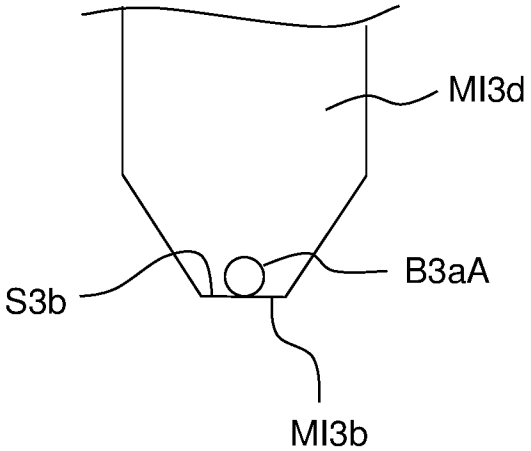
FIG. 13A is a plan view depicting a connecting portion of a bypass channel with respect to a supply manifold channel of the third embodiment.

The upstream end B3*a* of the bypass channel B3 is connected to the lower surface MI3*d* of the supply manifold channel MI3 at the downstream end MI3*b* of the supply manifold channel MI3 to define a circular opening B3*a*A (FIG. 13A). The opening B3*a*A makes contact with the end surface S3*b* positioned at the downstream end MI3*b* of the supply manifold channel MI3. That is, the portion of the circumferential surface of the inflow channel 7, which is positioned on the most downstream side of the supply manifold channel MI3, is flush with the side surface S3*b* disposed on the downstream side of the supply manifold channel MI3.

The downstream end B3*b* of the bypass channel B3 is connected to the lower surface MO3*d* of the return manifold channel MO3 at the upstream end MO3*a* of the return manifold channel MO3 to define a circular opening B3*b*A (FIG. 13B). The opening B3*b*A makes contact with the end surface S3*a* positioned at the upstream end MO3*a* of the return manifold channel MO3. That is, the portion of the circumferential surface of the outflow channel 9, which is positioned on the most upstream side of the return manifold channel MO3, is flush with the side surface S3*a* disposed on the upstream side of the return manifold channel MO3.

The channel resistance of the bypass channel B3 constructed as described above is smaller than about 12 kpa·s/cc assuming that the viscosity of the liquid flowing inside the channel is 1 cps. Note that the channel resistance of the individual channel ICH is about $11\times10^3$ to $13\times10^3$ kpa·s/cc, which is about 1000 times the channel resistance of the bypass channel B3, assuming that the viscosity of the liquid flowing inside the channel is 1 cps. The channel resistance of the bypass channel B3 may be not more than 1/500 of the channel resistance of the individual channel ICH, and the channel resistance of the bypass channel B3 may be not more than 1/1000 of the channel resistance of the individual channel ICH.

Further, the channel resistances of the supply manifold channel MI3 and the return manifold channel MO3 are about 2 to 4 kpa·s/cc assuming that the viscosity of the liquid flowing inside the channel is 1 cps. The channel resistance of the bypass channel B3 is about three times to six times the channel resistances of the supply manifold channel MI3 and the return manifold channel MO3.

<Piezoelectric Actuator 70>

An accommodating space R, which extends in parallel to the pressure chamber array $L_{32}$ in the sheet feeding direction, is formed over the pressure chamber array $L_{32}$ by removing a part of the second plate 30D. The shape of the accommodating space R, which is viewed in a plan view, is a lengthy rectangular shape extending in the sheet feeding direction (FIG. 10). The dimension of the accommodating space R in the sheet widthwise direction is smaller than the dimension of the pressure chamber 32 in the sheet widthwise direction.

The bottom surface of the accommodating space R is formed by the insulator film 30C2 of the vibration plate 30C.

Each of the plurality of piezoelectric actuators 70 is formed at the inside of the accommodating space R so that each of the plurality of piezoelectric actuators 70 is positioned over each of the plurality of pressure chambers 32 as viewed in a plan view.

Each of the plurality of piezoelectric actuators 70 includes a common electrode layer 71 which is stacked on the insulator film 30C2, a piezoelectric layer 72 which is stacked on the common electrode layer 71, and an individual electrode layer 73 which is stacked on the piezoelectric layer 72.

For discharging the ink from a desired nozzle 33, the driver IC (not depicted) applies the driving electric potential to the individual electrode 73 of the piezoelectric actuator 70 disposed over the pressure chamber 32 (referred to as "target pressure chamber") of the individual channel ICH3 including the desired nozzle 33. As a result, the volume of the target pressure chamber is decreased in accordance with the action which is the same as or equivalent to that of the piezoelectric actuator 50 of the first embodiment. The pressure of the ink at the inside is raised, and the liquid droplets of the ink are discharged from the nozzle 33.

<Image Forming Method>

The image formation on the sheet P, which is based on the use of the printer 3000 and the ink-jet head 130, is also performed in the same manner as the image formation on the sheet P which is based on the use of the printer 1000 and the ink-jet head 110 of the first embodiment.

The printer 3000 maintains the circulation of the ink (hereinafter simply referred to as "ink circulation") along the circulating channel from the subtank 600 via the ink supply channel 701, the supply manifold channel MI3, the bypass channel B3 or the individual channel ICH3, the return manifold channel MO3, and the ink recovery channel 702 to return to the subtank 600 by means of the pump 800 even in the period in which the ink is not discharged by the ink-jet head 130, in the same manner as the printer 1000.

<Prevention and Dissolution of Sedimentation by Means of Bypass Channel>

Next, an explanation will be made about the prevention and the dissolution of the sedimentation by using the bypass channel B3 of this embodiment.

In the case of the ink-jet head 130 of this embodiment, the bypass channel B3, which has the channel resistance larger than that of the supply manifold channel MI3 (about three to six times), is connected to the downstream end of the supply manifold channel MI3. Therefore, the ink contained in the supply manifold channel MI3 is agitated by the ink which flows into the bypass channel B while being accelerated. The occurrence of any sedimentation is suppressed.

In particular, in the case of the ink-jet head 130 of this embodiment, the upstream end B3*a* of the bypass channel B3 is also connected to the lower surface MI3*d* of the supply manifold channel MI3 to which the individual channel ICH3 is connected. The ink, which flows through the supply manifold channel MI3 in accordance with the ink circulation, has the flow rate which is especially increased in the vicinity of the lower surface MI3*d* to which the upstream end B3*a* of the bypass channel B3 is connected. Therefore, the ink is agitated especially greatly in the vicinity of the lower surface MI3*d* of the supply manifold channel MI3. The accumulation of the pigment due to the sedimentation is suppressed more reliably at the connecting portion of the individual channel ICH3 connected to the lower surface MI3*d*. Further, even if the accumulation of the pigment exists on the lower surface MI3*d*, then the accumulated pigment is agitated by the ink flowing to the bypass channel B3 at the large flow rate, and the accumulation is dissolved.

Further, in the case of the ink-jet head 130 of this embodiment, the tapered portion TA is provided in the vicinity of the downstream end MI3*b* of the supply manifold channel MI3. Therefore, the ink, which flows through the supply manifold channel MI3, has the flow rate which is further increased at positions nearer to the downstream end MI3*b*. Accordingly, the flow rate of the ink is also increased in the entire region of the supply manifold channel MI3. The ink is agitated to a greater extent.

Further, in the case of the ink-jet head 130 of this embodiment, the bypass channel B3, which has the channel resistance larger than that of the return manifold channel MO3 (about three to six times), is connected to the upstream end of the return manifold channel MO3. Therefore, the ink contained in the return manifold channel MO3 is agitated by the ink outflowing from the bypass channel B3 at the large flow rate. The occurrence of the sedimentation is suppressed.

In particular, in the case of the ink-jet head 130 of this embodiment, the downstream end B3*b* of the bypass channel B3 is also connected to the lower surface MO3*d* of the return manifold channel MO3 to which the individual channel ICH3 is connected. The ink, which flows through the return manifold channel MO3 in accordance with the ink circulation, has the flow rate which is especially increased in the vicinity of the lower surface MO3*d* to which the downstream end B3*b* of the bypass channel B3 is connected. Therefore, the ink is agitated especially greatly in the vicinity of the lower surface MO3*d* of the return manifold channel MO3. The accumulation of the pigment is suppressed more reliably at the connecting portion of the individual channel ICH3 connected to the lower surface MO3*d*. Further, even if the accumulation of the pigment due to the sedimentation exists on the lower surface MO3*d*, then the accumulated pigment is agitated by the ink outflowing from the bypass channel B3, and the accumulation is dissolved.

Main effects of the ink-jet head 130 and the image recording apparatus 3000 of this embodiment are summarized below.

The ink-jet head 130 of this embodiment is provided with the bypass channel B3 which connects the supply manifold channel MI3 and the return manifold channel MO3. Therefore, the ink contained in the supply manifold channel MI3 can be agitated by the ink which inflows into the bypass channel B3. In particular, the connecting portion of the bypass channel B3 with respect to the supply manifold channel MI3 is the lower surface MI3*d* of the supply manifold channel MI3. Therefore, the flow rate of the ink in the supply manifold channel MI3 is especially increased in the vicinity of the lower surface MI3*d*. It is possible to more reliably suppress the sedimentation of the pigment with respect to the connecting portion of the individual channel ICH3 connected to the lower surface MI3*d* as well.

The ink-jet head 130 of this embodiment is provided with the bypass channel B3 which connects the supply manifold channel MI3 and the return manifold channel MO3. Therefore, the ink contained in the return manifold channel MO3 can be agitated by the ink which outflows from the bypass channel B3. In particular, the connecting portion of the bypass channel B3 with respect to the return manifold channel MO3 is the lower surface MO3*d* of the return manifold channel MO3. Therefore, the flow rate of the ink in the return manifold channel MO3 is especially increased in the vicinity of the lower surface MO3*d*. It is possible to more reliably suppress the sedimentation of the pigment with respect to the connecting portion of the individual channel ICH3 connected to the lower surface MO3*d* as well.

The image recording apparatus 3000 of this embodiment can satisfactorily perform the image formation by using the ink which is retained in the satisfactory state by the ink-jet head 130 of this embodiment.

Modified Embodiments

The following modification modes can be also adopted for the ink-jet heads 110 to 130 of the first to third embodiments.

In the ink-jet head 110 of the first embodiment, the upstream end Ba of the bypass channel B is connected to the upper surface MIu of the supply manifold channel MI, and the downstream end Bb of the bypass channel B is connected to the lower surface MOd of the return manifold channel MO. However, there is no limitation thereto.

Figure 14:
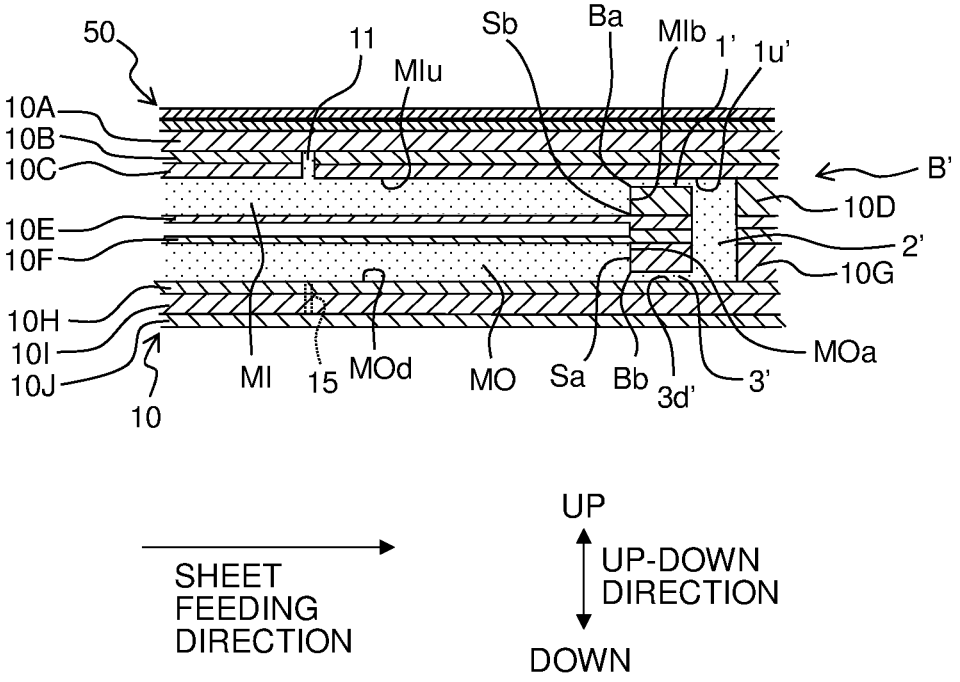
FIG. 14 is a sectional view depicting a modified embodiment of the bypass channel of the first embodiment. The position of cross section is a position corresponding to the cross-sectional position of FIG. 3.

Specifically, for example, as depicted in FIG. 14, the upstream end Ba of the bypass channel B may be connected to the end surface Sb positioned at the downstream end MIb of the supply manifold channel MI, and the downstream end Bb of the bypass channel B may be connected to the end surface Sa positioned at the upstream end MOa of the return manifold channel MO.

The bypass channel B' of this mode has an inflow channel (first straight channel) 1' which extends linearly in the extending direction of the supply manifold channel MI, i.e., in the sheet feeding direction from the upper end portion of the end surface Sb of the supply manifold channel MI, a connecting channel 2' which extends downwardly from the downstream end of the inflow channel 1', and an outflow channel (second straight channel) 3' which extends linearly in the sheet feeding direction from the downstream end of the connecting passage 2' and which arrives at the lower end portion of the end surface Sa of the return manifold channel MO.

In this modified embodiment, the upper surface 1*u*' of the inflow channel 1' is formed by the lower surface of the plate 10C in the same manner as the upper surface MIu of the supply manifold channel MI. The upper surface 1*u*' of the inflow channel 1' is flush with the upper surface MIu of the manifold channel MI. Further, the lower surface 3*d*' of the outflow channel 3' is formed by the upper surface of the plate 10H in the same manner as the lower surface MOd of the return manifold channel MO. That is, the lower surface 3*d*' of the outflow channel 3' is flush with the lower surface MOd of the return manifold channel MO. However, there is no limitation thereto. Any step (difference in height) may be present between the upper surface 1*u*' of the inflow channel 1' and the upper surface MIu of the supply manifold channel MI. Further, any step (difference in height) may be present between the lower surface 3*d*' of the outflow channel 3' and the lower surface MOd of the return manifold channel MO.

In the mode in which the extending directions of the inflow channel 1' and the outflow channel 3' are coincident with the extending directions of the supply manifold channel MI and the return manifold channel MO as described above, the ink can inflow from the supply manifold channel MI into the bypass channel B' without changing the direction, and the ink can outflow from the bypass channel B' to the return manifold channel MO without changing the direction. On this account, the ink, which flows through the supply manifold channel MI and the return manifold channel MO in accordance with the ink circulation, has the flow rate which is more increased. The bubbles are discharged more quickly from the supply manifold channel MI. The sedimentation is prevented and dissolved more reliably in the return manifold channel MO.

Figure 15A:
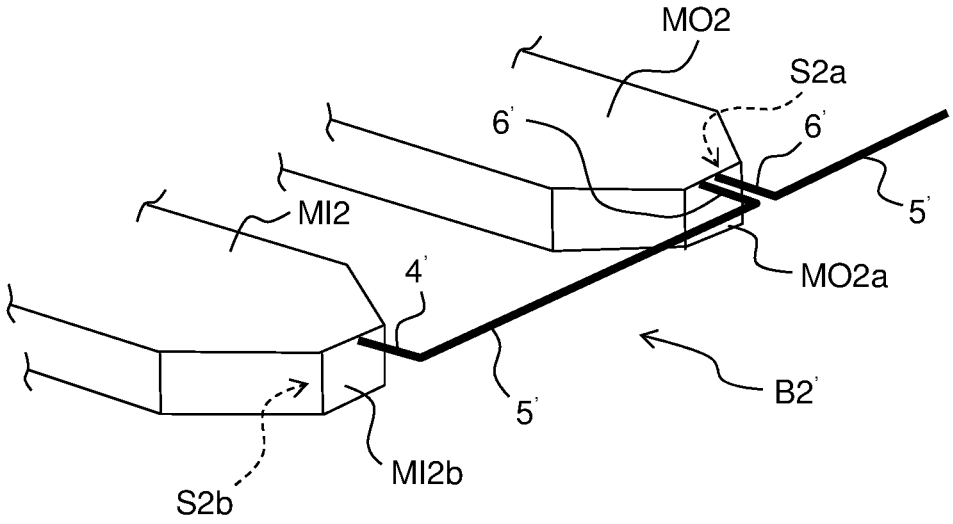
FIG. 15A is a perspective view depicting a modified embodiment of the bypass channel of the second embodiment.
Figure 15B:
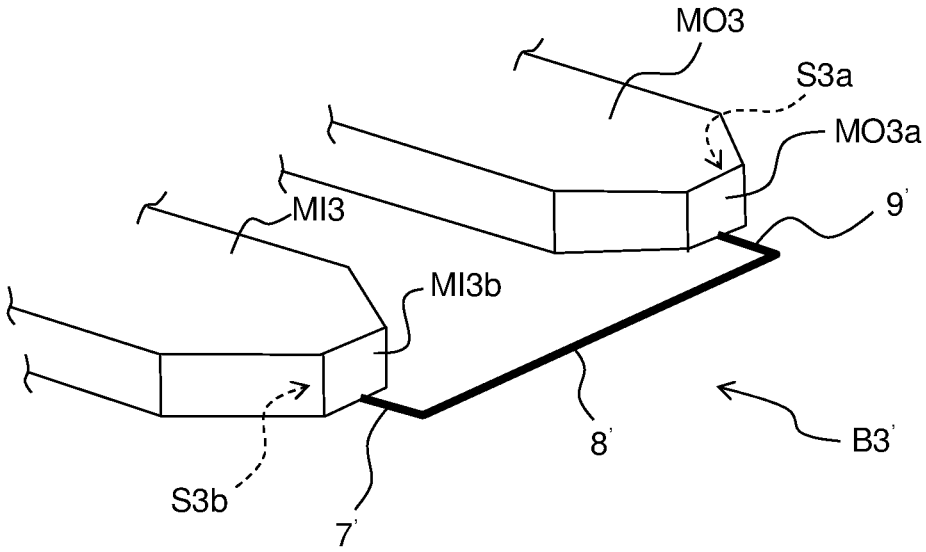
FIG. 15B is a perspective view depicting a modified embodiment of the bypass channel of the third embodiment.

The ink-jet head 120 of the second embodiment may be provided with a bypass channel B2' in place of the bypass channel B2 in the same manner as described above (FIG. 15A). The bypass channel B2' has an inflow channel (first straight channel) 4' which extends linearly in the extending direction of the supply manifold channel MI2, i.e., in the sheet feeding direction from the upper end portion of the end surface S2*b* positioned at the downstream end MI2*b* of the supply manifold channel MI2, a connecting channel 5' which extends in the sheet width direction from the downstream end of the inflow channel 4', and an outflow channel (second straight channel) 6' which extends linearly in the sheet feeding direction from the downstream end of the connecting passage 5' and which arrives at the upper end portion of the end surface S2*a* positioned at the upstream end MO2*a* of the return manifold channel MO2. The upper surface of the inflow channel 4' may be flush with the upper surface MI2*u* of the supply manifold channel MI2, provided that the present invention is not limited thereto. Similarly, the upper surface of the outflow channel 6' may be flush with the upper surface MO2*u* of the return manifold channel MO2, provided that the present invention is not limited thereto.

The ink-jet head 130 of the third embodiment may be also provided with a bypass channel B3' in place of the bypass channel B3 in the same manner as described above. The bypass channel B3' has an inflow channel (first straight channel) 7' which extends linearly in the extending direction of the supply manifold channel MI3, i.e., in the sheet feeding direction from the lower end portion of the end surface S3*b* positioned at the downstream end MI3*b* of the supply manifold channel MI3, a connecting channel 8' which extends in the sheet width direction from the downstream end of the inflow channel 7', and an outflow channel (second straight channel) 9' which extends linearly in the sheet feeding direction from the downstream end of the connecting passage 8' and which arrives at the lower end portion of the end surface S3*a* positioned at the upstream end MO3*a* of the return manifold channel MO3. The lower surface of the inflow channel 7' may be flush with the lower surface MI3*d* of the supply manifold channel MI3, provided that the present invention is not limited thereto. Similarly, the lower surface of the outflow channel 9' may be flush with the lower surface MO3*d* of the return manifold channel MO3, provided that the present invention is not limited thereto.

The connecting position of the bypass channel B, B2, B3 with respect to the supply manifold channel MI, MI2, MI3 is arbitrary provided that the connecting position is disposed on the downstream side from the individual channel ICH, ICH2, ICH3 connected on the most downstream side of the supply manifold channel MI, MI2, MI3 in the extending direction of the supply manifold channel MI, MI2, MI3.

The connecting position of the bypass channel B, B2, B3 with respect to the return manifold channel MO, MO2, MO3 is arbitrary provided that the connecting position is disposed on the upstream side from the individual channel ICH, ICH2, ICH3 connected on the most upstream side of the return manifold channel MO, MO2, MO3 in the extending direction of the return manifold channel MO, MO2, M03.

The connecting position of the bypass channel with respect to the supply manifold channel and the return manifold channel is as follows in the up-down direction. That is, when the individual channel is connected on the upper side as compared with the central portion (vertical center) between the upper surface (first upper surface, second upper surface) and the lower surface (first lower surface, second lower surface) of each of the manifold channels, the connecting position may be disposed only in an arbitrary area on the upper side as compared with the vertical center of each of the manifold channels. Accordingly, the flow rate of the ink is increased on the upper side as compared with the vertical center of each of the manifold channels, and it is possible to suppress the contamination with the bubbles in relation to the individual channel connected on the upper side as compared with the vertical center of each of the manifold channels. On the other hand, when the individual channel is connected on the lower side as compared with the central portion (vertical center) between the upper surface (first upper surface, second upper surface) and the lower surface (first lower surface, second lower surface) of each of the manifold channels, the connecting position may be disposed only in an arbitrary area on the lower side as compared with the vertical center of each of the manifold channels. Accordingly, the flow rate of the ink is increased on the lower side as compared with the vertical center of each of the manifold channels, and it is possible to suppress the sedimentation of the pigment onto the opening of the individual channel connected on the lower side as compared with the vertical center of each of the manifold channels.

When the bypass channel is connected to the side surface of the supply manifold channel only on the upper side as compared with the vertical center of the side surface, the connecting portion of the bypass channel with respect to the supply manifold channel (i.e., the opening of the bypass channel with respect to the supply manifold channel) may be positioned only in a band-shaped area having a width (vertical width) of 0.1×D1 with the upper surface of the supply manifold channel being provided as an upper edge and extending along the upper surface or may be positioned only in a band-shaped area having a width of 0.05×D1, assuming that D1 is the distance between the upper surface (first upper surface) and the lower surface (first lower surface). Accordingly, the flow rate of the ink can be more quickened in the vicinity of the upper surface of the supply manifold channel, and the bubbles can be washed away more quickly. When the bypass channel is connected to the side surface of the supply manifold channel only on the lower side as compared with the vertical center of the side surface, the connecting portion of the bypass channel with respect to the supply manifold channel (i.e., the opening of the bypass channel with respect to the supply manifold channel) may be positioned only in a band-shaped area having a width (vertical width) of 0.1×D1 with the lower surface of the supply manifold channel being provided as a lower edge and extending along the lower surface or may be positioned only in a band-shaped area having a width of 0.05×D1. Accordingly, the flow rate of the ink can be more quickened in the vicinity of the lower surface of the supply manifold channel, and the sedimentation can be prevented and dissolved more reliably.

Similarly, when the bypass channel is connected to the side surface of the return manifold channel only on the upper side as compared with the vertical center of the side surface, the connecting portion of the bypass channel with respect to the return manifold channel (i.e., the opening of the bypass channel with respect to the return manifold channel) may be positioned only in a band-shaped area having a width (vertical width) of 0.1×D2 with the upper surface of the return manifold channel being provided as an upper edge and extending along the upper surface or may be positioned only in a band-shaped area having a width of 0.05×D2, assuming that D2 is the distance between the upper surface (second upper surface) and the lower surface (second lower surface). When the bypass channel is connected to the side surface of the return manifold channel only on the lower side as compared with the vertical center of the side surface, the connecting portion of the bypass channel with respect to the return manifold channel (i.e., the opening of the bypass channel with respect to the return manifold channel) may be positioned only in a band-shaped area having a width (vertical width) of 0.1×D2 with the lower surface of the return manifold channel being provided as a lower edge and extending along the lower surface or may be positioned only in a band-shaped area having a width of 0.05×D2.

Each of the ink-jet heads 110, 120, 130 of the first to third embodiments may be provided with an auxiliary bypass channel SB, SB2, SB3 in addition to the bypass channel B, B2, B3. The auxiliary bypass channel SB, SB2, SB3 is connected to the supply manifold channel MI, MI2, MI3 and the return manifold channel MO, MO2, MO3 on the side opposite to the bypass channel B, B2, B3 in the up-down direction of the supply manifold channel MI, MI2, MI3 and the return manifold channel MO, MO2, MO3.

Figure 16:
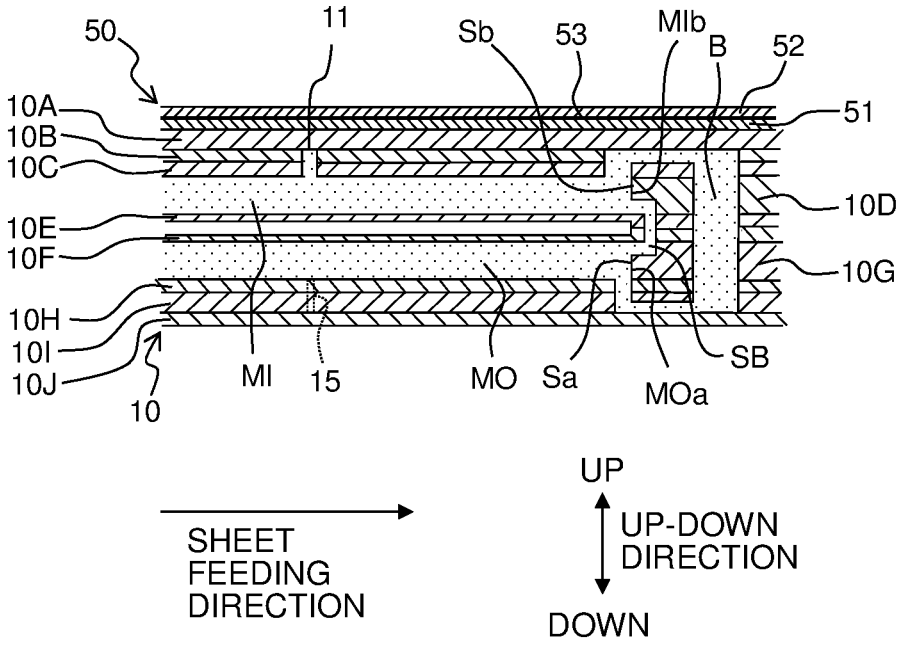
FIG. 16 is a sectional view depicting an auxiliary bypass channel of an ink-jet head of a modified embodiment of the first embodiment. The position of cross section is a position corresponding to the cross-sectional position of FIG. 3.

For example, as depicted in FIG. 16, the auxiliary bypass channel SB, which is provided for the ink-jet head 110 of the first embodiment, may be formed as a channel having a U-shaped form as viewed in a side view extending from the lower end portion of the end surface Sb positioned at the downstream end MIb of the supply manifold channel MI to the upper end portion of the end surface Sa positioned at the upstream end MOa of the return manifold channel MO. Owing to the provision of the auxiliary bypass channel SB as described above, it is possible to increase the flow rate in the vicinity of the lower surface of the supply manifold channel MI, and it is possible to increase the flow rate in the vicinity of the upper surface of the return manifold channel MO. Therefore, the sedimentation is also prevented and dissolved in the supply manifold channel MI, and the bubbles are also allowed to flow quickly in the vicinity of the upper surface in the return manifold channel MO. Note that the auxiliary bypass channel SB may be merged into the bypass channel B at an intermediate position of the route or path.

Figure 17A:
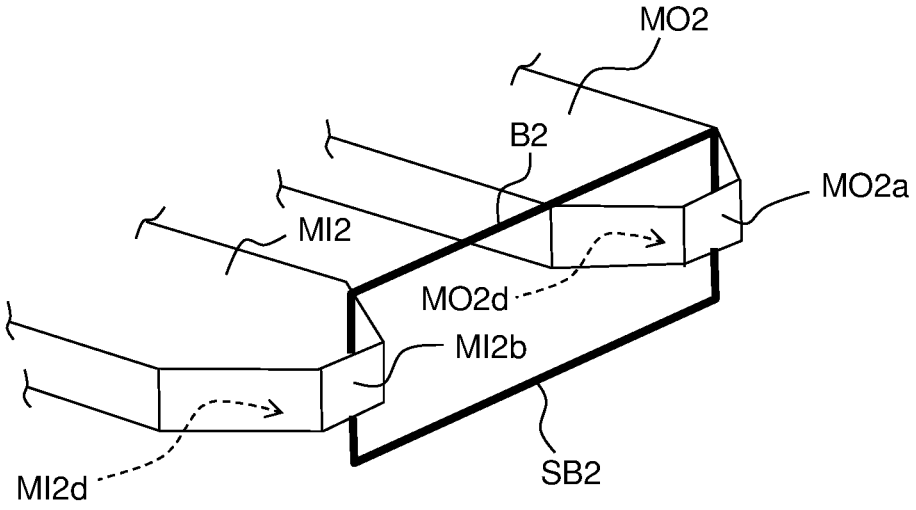
FIG. 17A is a perspective view depicting an auxiliary bypass channel of an ink-jet head of a modified embodiment of the second embodiment.
Figure 17B:
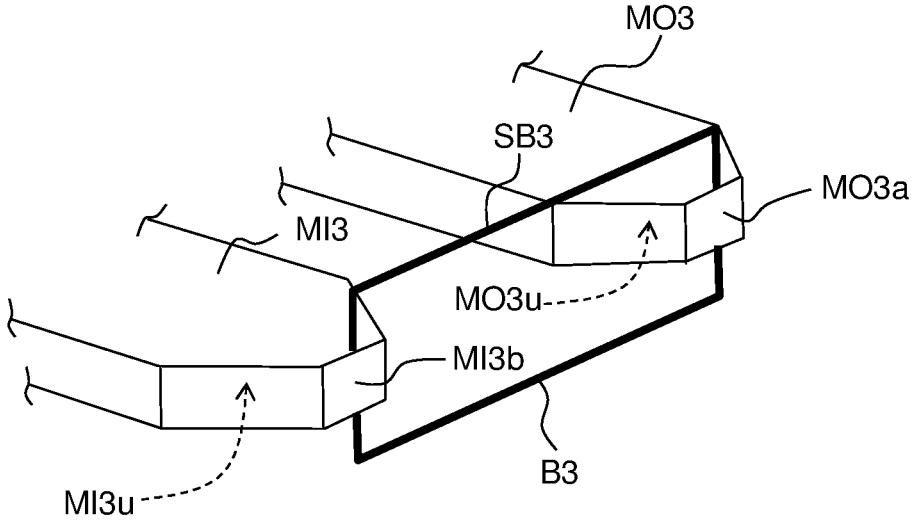
FIG. 17B is a perspective view depicting an auxiliary bypass channel of an ink-jet head of a modified embodiment of the third embodiment.

For example, as depicted in FIG. 17A, the auxiliary bypass channel SB2, which is provided for the ink-jet head 120 of the second embodiment, may be formed as a channel having a U-shaped form as viewed in a side view extending from the lower surface MI2*d* in the vicinity of the downstream end MI2*b* of the supply manifold channel MI2 to the lower surface MO2*d* in the vicinity of the upstream end MO2*a* of the return manifold channel MO2. For example, as depicted in FIG. 17B, the auxiliary bypass channel SB3, which is provided for the ink-jet head 130 of the third embodiment, may be formed as a channel having a U-shaped form as viewed in a side view extending from the upper surface MI3*u* in the vicinity of the downstream end MI3*b* of the supply manifold channel MI3 to the upper surface MO3*u* in the vicinity of the upstream end MO3*a* of the return manifold channel MO3.

Various modes can be also adopted for the connecting position of the auxiliary bypass channel SB, SB2, SB3 with respect to each of the manifold channels, in the same manner as the connecting position of the bypass channel S, S2, S3 with respect to each of the manifold channels. However, unlike the bypass channel, the auxiliary bypass channel is connected on the side opposite to the connecting position of the individual channel with respect to each of the manifold channels in the up-down direction.

In the first embodiment, the cross-sectional area, which is provided at the upstream end Ba and the downstream end Bb of the bypass channel B (i.e., the opening of the bypass channel B with respect to each of the manifold channels), may be smaller than the cross-sectional area which is provided at any other portion of the bypass channel B. Accordingly, the flow rate of the ink is raised in the vicinity of the upstream end Ba and the downstream end Bb. The inflow of the bubbles into the bypass channel B is facilitated, or the dissolution of the sedimentation caused by the ink outflowing, for example, from the bypass channel B is facilitated. The same or equivalent situation is also brought about for the bypass channels and the auxiliary bypass channel of the other respective embodiments and the modified embodiments.

Figure 18:
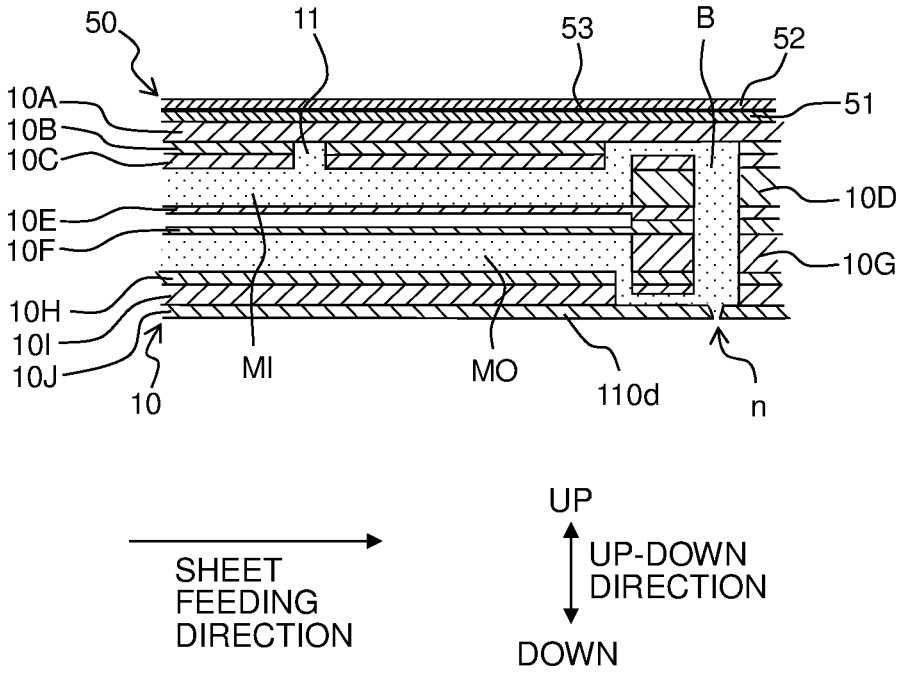
FIG. 18 is a sectional view depicting a nozzle for a bypass channel of an ink-jet head of a modified embodiment of the first embodiment. The position of cross section is a position corresponding to the cross-sectional position of FIG. 4.

In the first embodiment and the modified embodiment thereof, a nozzle n, which extends from the bypass channel B to the lower surface 110*d* of the ink-jet head 110, may be formed. As depicted in FIG. 18, the nozzle n is formed by removing a part of the plate 10J.

Figure 19:
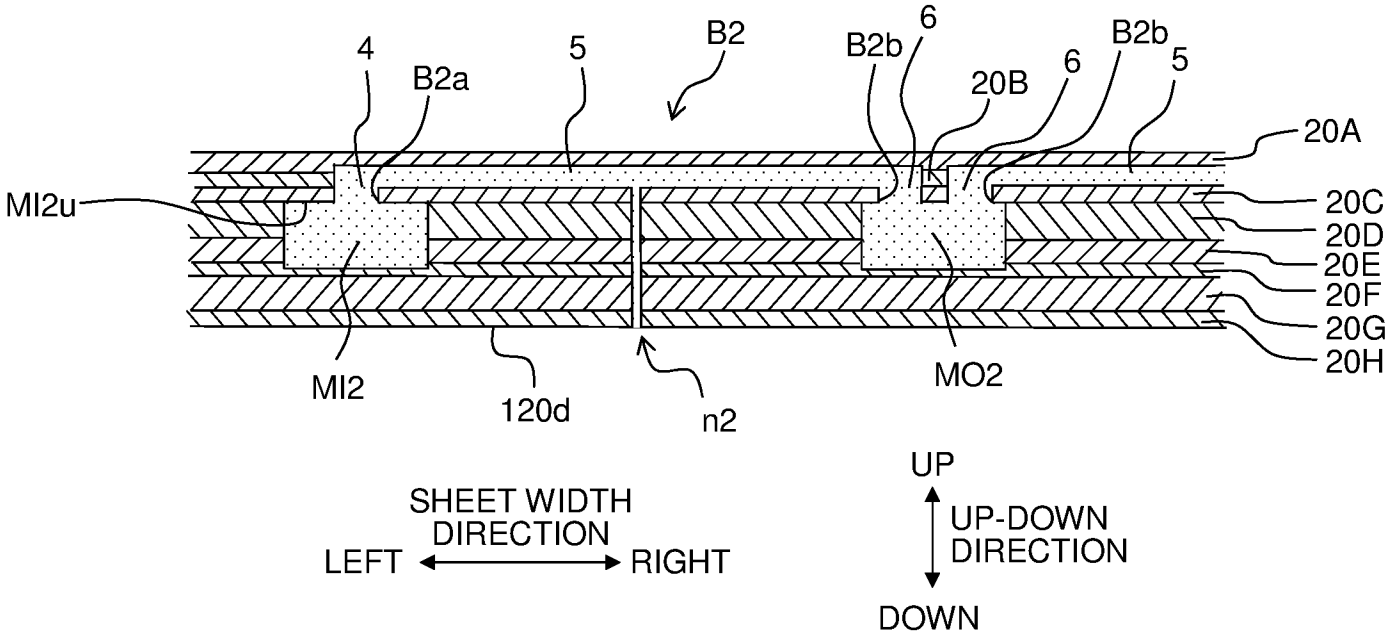
FIG. 19 is a sectional view depicting a nozzle for a bypass channel of an ink-jet head of a modified embodiment of the second embodiment. The position of cross section is a position corresponding to the cross-sectional position of FIG. 8.

In the second embodiment and the modified embodiment thereof, a nozzle n2, which extends from the bypass channel B2 to the lower surface 120*d* of the ink-jet head 120, may be formed. As depicted in FIG. 19, the nozzle n2 is formed by removing parts of the plates 20C to 20H.

Figure 20:
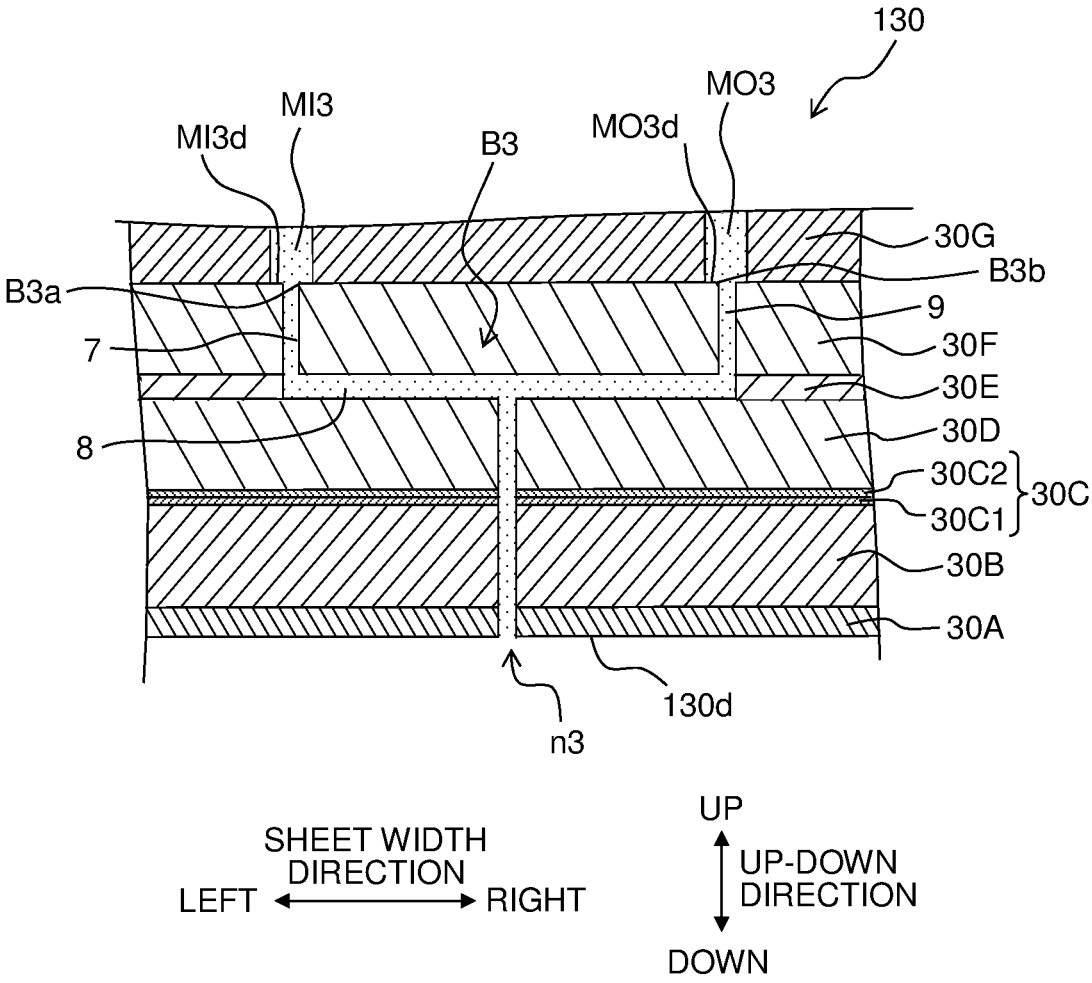
FIG. 20 is a sectional view depicting a nozzle for a bypass channel of an ink-jet head of a modified embodiment of the third embodiment. The position of cross section is a position corresponding to the cross-sectional position of FIG. 12.

In the third embodiment and the modified embodiment thereof, a nozzle n3, which extends from the bypass channel B3 to the lower surface 130*d* of the ink-jet head 130, may be formed. As depicted in FIG. 20, the nozzle n3 is formed by removing parts of the discharge plate 30A, the first plate 30B, the vibration plate 30C, and the second plate 30D.

For example, when the use of the ink-jet head is started, the ink is drawn into the channel by applying the negative pressure to the ink discharging nozzle in order to charge the ink into the empty channel in the ink-jet head. In this procedure, when the nozzle n, n2, n3 of the modified embodiment of the present disclosure is provided, the ink can be satisfactorily charged into the bypass channel B, B2, B3 as well by applying the negative pressure to the nozzle n, n2, n3 in the same manner as described above.

In the ink-jet heads 110, 120, 130 of the first to third embodiments, it is also allowable that the supply manifold channel MI, MI2, MI3 and the return manifold channel MO, MO2, MO3 do not have the tapered portion TA.

In the ink-jet heads 110, 120, 130 of the first to third embodiments, the individual channel is connected to the upper surface or the lower surface of the supply manifold channel and the return manifold channel. However, there is no limitation thereto. The individual channel may be also connected to the side surfaces of the supply manifold channel and the return manifold channel.

In the foregoing description, the embodiments and the modified embodiments have been explained as exemplified, for example, by the case in which the image is formed on the sheet P by discharging the ink from the ink-jet head 110, 120, 130. However, the present invention is not limited thereto. The ink-jet head 110, 120, 130 may be a liquid discharge apparatus for discharging any arbitrary liquid in order to form an image, and the medium, on which the image is to be formed, may be, for example, fiber or resin other than the sheet P. Further, the ink-jet head 110, 120, 130 may be used as an ink-jet head of a serial head type printer.

The present invention is not limited to the embodiments described above provided that the feature of the present invention is maintained. Any other form, which is conceivable within the scope of the technical concept of the present invention, is also included in the scope of the present invention.

According to the liquid discharge apparatus and the image recording apparatus of the present disclosure, it is possible to perform the high quality image formation by maintaining the internal liquid in the liquid discharge apparatus to be in the satisfactory state suitable for the image formation.

According to the liquid discharge apparatus and the image recording apparatus of the present disclosure, it is possible to maintain the internal liquid in the liquid discharge apparatus to be in a satisfactory state suitable for the image formation.

What is claimed is:

1. A liquid discharge apparatus configured to discharge a liquid, comprising a channel member for the liquid, wherein:

the channel member is formed to include:

a plurality of individual channels each of which has a nozzle configured to discharge the liquid;

a first manifold channel which extends in a first direction so as to be connected to each of the plurality of individual channels, and which is configured to allow the liquid to flow toward one end in the first direction of the first manifold channel so as to distribute the liquid to each of the plurality of individual channels;

a second manifold channel which extends in a second direction so as to be connected to each of the plurality of individual channels, and which is configured to allow the liquid to flow from each of the plurality of individual channels toward one end in the second direction of the second manifold channel; and a bypass channel which is connected to the first manifold channel and the second manifold channel, and which is configured to allow the liquid in the first manifold channel to flow to the second manifold channel;

each of the plurality of individual channels is connected to the first manifold channel on an upper side or a lower side, of the first manifold channel, than a central portion between upper and lower surfaces of the first manifold channel; and each of the plurality of individual channels is connected to the second manifold channel on an upper side or a lower side, of the second manifold channel, than a central portion between upper and lower surfaces of the second manifold channel;

the bypass channel is connected to the first manifold channel on one side, among the upper and lower sides of the first manifold channel, which is the same as a side on which the plurality of individual channels is connected to the first manifold channel;

the bypass channel is connected to the second manifold channel on one side, among the upper and lower sides of the second manifold channel, which is the same as a side on which the plurality of individual channels is connected to the second manifold channel;

the bypass channel is connected to the first manifold channel at a position between the one end of the first manifold channel and a connecting portion, among connecting portions between each of the plurality of individual channels and the first manifold channel, closest to the one end of the first manifold channel, and the bypass channel is connected to the second manifold channel at a position between another end in the second direction of the second manifold channel and a connecting portion, among connecting portions between each of the plurality of individual channels and the second manifold channel, closest to the other end of the second manifold channel, the other end of the second manifold channel being opposite to the one end of the second manifold channel; and a channel resistance of the bypass channel is smaller than a channel resistance of each of the plurality of individual channels.

2. The liquid discharge apparatus according to claim 1, wherein the upper side than the central portion of the first manifold channel includes the upper surface of the first manifold channel and an area, of a wall surface of the first manifold channel extending between the upper and lower surfaces of the first manifold channel, positioned above the central portion; and the lower side than the central portion of the first manifold channel includes the lower surface of the first manifold channel and an area, of the wall surface of the first manifold channel, positioned below the central portion.

3. The liquid discharge apparatus according to claim 1, wherein the upper side than the central portion of the second manifold channel includes the upper surface of the second manifold channel, and an area, of a wall surface of the second manifold channel extending between the upper and lower surfaces of the second manifold channel, positioned above the central portion; and the lower side than the central portion of the second manifold channel includes the lower surface of the second manifold channel and an area, of the wall surface of the second manifold channel, positioned below the central portion.

4. The liquid discharge apparatus according to claim 1, wherein:

an opening of the bypass channel to the first manifold channel is positioned on an end surface at the one end of the first manifold channel, or positioned on the upper or lower surface of the first manifold channel such that the opening is in contact with the end surface at the one end of the first manifold channel; and an opening of the bypass channel to the second manifold channel is positioned on an end surface at the other end of the second manifold channel, or positioned on the upper or lower surface of the second manifold channel such that the opening is in contact with the end surface at the other end of the second manifold channel.

5. The liquid discharge apparatus according to claim 4, wherein:

the opening of the bypass channel to the first manifold channel is positioned on the end surface at the one end of the first manifold channel, and the opening of the bypass channel to the second manifold channel is positioned on the end surface at the other end of the second manifold channel; and the bypass channel includes a first straight channel which extends in the first direction from the end surface of the first manifold channel and a second straight channel which extends in the second direction so as to arrive at the end surface of the second manifold channel.

6. The liquid discharge apparatus according to claim 1, wherein:

a distance between the upper and lower surfaces of the first manifold channel is assumed to be D1; and the bypass channel is connected to the first manifold channel on only the upper side than the central portion of the first manifold channel, and an opening of the bypass channel to the first manifold channel is positioned in only a band-shaped area having a width of 0.1×D1, an upper edge of the band-shaped area being the upper surface of the first manifold channel, or the bypass channel is connected to the first manifold channel on only the lower side than the central portion of the first manifold channel, and the opening of the bypass channel to the first manifold channel is positioned in only a band-shaped area having a width of 0.1×D1, a lower edge of the band-shaped area being the lower surface of the first manifold channel.

7. The liquid discharge apparatus according to claim 1, wherein:

a distance between the upper and lower surfaces of the second manifold channel is assumed to be D2; and the bypass channel is connected to the second manifold channel on only the upper side than the central portion of the second manifold channel, and an opening of the bypass channel to the second manifold channel is positioned in only a band-shaped area having a width of 0.1×D2, an upper edge of the band-shaped area being the upper surface of the second manifold channel, or the bypass channel is connected to the second manifold channel on only the lower side than the central portion of the second manifold channel, and the opening of the bypass channel to the second manifold channel is positioned in only a band-shaped area having a width of 0.1×D1, a lower edge of the band-shaped area being the lower surface of the second manifold channel.

8. The liquid discharge apparatus according to claim 1, wherein:

that the bypass channel is connected to the first manifold channel on only the upper side than the central portion of the first manifold channel, and an upper surface of the bypass channel is flush with the upper surface of the first manifold channel; or the bypass channel is connected to the first manifold channel on only the lower side than the central portion of the first manifold channel, and a lower surface of the bypass channel is flush with the lower surface of the first manifold channel.

9. The liquid discharge apparatus according to claim 1, wherein:

the bypass channel is connected to the second manifold channel on only the upper side than the central portion of the second manifold channel, and an upper surface of the bypass channel is flush with the upper surface of the second manifold channel; or the bypass channel is connected to the second manifold channel on only the lower side than the central portion of the second manifold channel, and a lower surface of the bypass channel is flush with the lower surface of the second manifold channel.

10. The liquid discharge apparatus according to claim 1, wherein a cross-sectional area of the bypass channel at an opening of the bypass channel to the first or second manifold channel is smaller than the cross-sectional area of the bypass channel at a region different from the opening, the cross-sectional area being provided by a plane orthogonal to an extending direction of the bypass channel.

11. The liquid discharge apparatus according to claim 1, wherein the channel member is further formed to include a nozzle which extends from the bypass channel to outside of the channel member.

12. The liquid discharge apparatus according to claim 1, wherein the channel member is further formed to include an auxiliary bypass channel which is connected to the first manifold channel at a position between the one end of the first manifold channel and the connecting portion, among the connecting portions between each of the plurality of individual channels and the first manifold channel, closest to the one end of the first manifold channel, and which is connected to the second manifold channel at a position between the other end in the second direction of the second manifold channel and the connecting portion, among the connecting portions between each of the plurality of individual channels and the second manifold channel, closest to the other end of the second manifold channel; and the auxiliary bypass channel is open to the first manifold channel on only one of the upper side and the lower side of the central portion of the first manifold channel, the one being different from a side on which the bypass channel is connected to the first manifold channel, and the auxiliary bypass channel is open to the second manifold channel on only one of the upper side and the lower side of the central portion of the second manifold channel, the one being different from a side on which the bypass channel is connected to the second manifold channel.

13. The liquid discharge apparatus according to claim 1, wherein each of the plurality of individual channels and the bypass channel are all connected to the first manifold channel on only the upper side of the central portion of the first manifold channel, and each of the plurality of individual channels and the bypass channel are all connected to the second manifold channel on only the lower side of the central portion of the second manifold channel.

14. The liquid discharge apparatus according to claim 1, wherein each of the plurality of individual channels and the bypass channel are all connected to the first manifold channel on only the lower side of the central portion of the first manifold channel, and each of the plurality of individual channels and the bypass channel are all connected to the second manifold channel on only the upper side of the central portion of the second manifold channel.

15. The liquid discharge apparatus according to claim 1, wherein each of the plurality of individual channels and the bypass channel are all connected to the first manifold channel on only the upper side of the central portion of the first manifold channel, and each of the plurality of individual channels and the bypass channel are all connected to the second manifold channel on only the upper side of the central portion of the second manifold channel.

16. The liquid discharge apparatus according to claim 1, wherein each of the plurality of individual channels and the bypass channel are all connected to the first manifold channel on only the lower side of the central portion of the first manifold channel, and each of the plurality of individual channels and the bypass channel are all connected to the second manifold channel on only the lower side of the central portion of the second manifold channel.

17. The liquid discharge apparatus according to claim 1, wherein the first manifold channel and the second manifold channel are formed so that at least a part of the first manifold channel and at least a part of the second manifold channel are overlapped with each other as viewed from above.

18. The liquid discharge apparatus according to claim 1, wherein the channel resistance of the bypass channel is larger than a channel resistance of the first manifold channel.

19. The liquid discharge apparatus according to claim 1, wherein the channel resistance of the bypass channel is not more than 1/500 of the channel resistance of each of the plurality of individual channels.

20. An image recording apparatus comprising:

the liquid discharge apparatus as defined in claim 1;

a liquid supply channel configured to supply a liquid to the liquid discharge apparatus;

a liquid recovery channel configured to recover the liquid from the liquid discharge apparatus; and a pump configured to apply a pressure such that the liquid flows in an order of the liquid supply channel, the first manifold channel, the bypass channel, the second manifold channel, and the liquid recovery channel.

* * * * *